US006200739B1

(12) United States Patent
Yamazaki

(10) Patent No.: US 6,200,739 B1
(45) **Date of Patent: *Mar. 13, 2001**

(54) METHOD FOR PROCESSING SILVER HALIDE PHOTOGRAPHIC MATERIAL

(75) Inventor: Kazuki Yamazaki, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 25 days.

This patent is subject to a terminal disclaimer.

(21) Appl. No.: 08/998,431

(22) Filed: Dec. 24, 1997

(30) Foreign Application Priority Data

Dec. 27, 1996 (JP) ..... 8-351070

(51) Int. Cl.[7] ..... G03C 5/29
(52) U.S. Cl. ..... 430/488
(58) Field of Search ..... 430/264, 488, 430/570

(56) References Cited

U.S. PATENT DOCUMENTS

| | | | | |
|---|---|---|---|---|
| 5,300,410 | | 4/1994 | Date et al. | 430/488 |
| 5,441,847 | * | 8/1995 | Fukawa et al. | 430/264 |
| 5,508,153 | * | 4/1996 | Ishikawa et al. | 430/264 |
| 5,523,196 | * | 6/1996 | Iwashita et al. | 430/488 |
| 5,691,108 | * | 11/1997 | Hirano et al. | 430/488 |
| 5,840,472 | * | 11/1998 | Sasaki et al. | 430/488 |

FOREIGN PATENT DOCUMENTS

| | | |
|---|---|---|
| 0 789 271 A1 | 8/1997 | (EP) . |
| 0 789 272 A1 | 8/1997 | (EP) . |
| 7-287338 | 10/1995 | (JP) . |

* cited by examiner

*Primary Examiner*—Hoa Van Le
(74) *Attorney, Agent, or Firm*—Sughrue, Mion, Zinn, Macpeak & Seas, PLLC

(57) ABSTRACT

A processing method comprising the steps of: imagewise exposing a silver halide photographic material comprising a support having thereon at least one light-sensitive silver halide emulsion layer; and developing the exposed photographic material, wherein said development is carried out in the presence of a compound represented by formula (I):

(I)

wherein D and E each represents a —CH═ group, a —C($R_0$)═ group or a nitrogen atom wherein $R_0$ represents a substituent; and $R_1$, $R_2$ and $R_3$, which may be the same or different, each represents a hydrogen atom, a halogen atom or a substituent bonded to the ring by any of a carbon atom, a nitrogen atom, an oxygen atom, a sulfur atom or a phosphorus atom, provided that at least one of $R_1$, $R_2$, $R_3$ and $R_0$ has an —SM group (wherein M represents an alkali metal atom, a hydrogen atom or an ammonium group), and when only one of E and D represents a nitrogen atom, E represents a nitrogen atom, D represents a —CH═ group or a —C($R_0$)═ group, and neither $R_2$ nor $R_3$ represents a hydroxyl group, and wherein the silver halide emulsion in said photographic material is spectrally sensitized with a specific dye.

13 Claims, No Drawings

METHOD FOR PROCESSING SILVER HALIDE PHOTOGRAPHIC MATERIAL

FIELD OF THE INVENTION

The present invention relates to a method for processing a silver halide photographic material, in particular, a silver halide photographic material for use in a photomechanical process. More specifically, the invention relates to a method for processing a silver halide photographic material suitable for a scanner and an image setter having an He—Ne laser, a red semiconductor laser, an LED, etc., as a light source, which can stably provide photographic capabilities such as high sensitivity, high contrast and high Dmax even in running processing and which generates less silver sludge.

BACKGROUND OF THE INVENTION

As one method of exposure of a photographic material, an image forming method by scanning is known which comprises scanning an original, exposing the silver halide photographic material on the basis of the image signals, and forming a negative or positive image corresponding to the original image. As light sources of such scanners, an He—Ne laser (633 nm), a red semiconductor laser (670 nm to 680 nm) and an LED (660 nm to 680 nm) have widely prevailed.

Further, a photographic material for a scanner having a superhigh contrast characteristic is demanded in the case of directly printing on a printing plate without a contact process after output from a scanner to a film or in the case of a scanner light source which has a soft beam profile. Moreover, a photographic material of high sensitivity is necessary in a scanning process for shortening the process, the increase in the degree of resolution, and for the elongation of the life of a light source.

Various patents have been disclosed with respect to sensitizing dyes of high sensitivity and less residual color. For example, trinuclear cyanines disclosed in JP-A-62-157057 (the term "JP-A" as used herein means an "unexamined published Japanese patent application"), JP-A-1-47449, JP-A-3-259135, JP-A-2-161424 and JP-A-4-318542, trinuclear merocyanines disclosed in JP-A-3-171135 and JP-A-5-224330, trimethine cyanines disclosed in JP-A-2-297541 and JP-A-4-57046, and tetramethine merocyanines disclosed in JP-A-7-287338 can be cited as examples thereof. Photographic materials in which the above sensitizing dyes and hydrazine derivatives are used in combination are disclosed in JP-A-7-287338, JP-A-4-311946, JP-A-4-178644, JP-A-5-224330, JP-A-6-194771 and JP-A-6-194774.

However, it is well known in the industry that sensitizing dyes influence, in addition to sensitivity, photographic capabilities such as fog and gradation. For example, quantities of an antifoggant must be added to a developing solution for suppressing fog, which deteriorates sensitivity.

In a silver halide photographic material which requires a development process of less photographic fluctuation in rapid running processing, a silver chloro-bromide emulsion which has high developability is used as a silver halide emulsion constituting a photographic material. It is known that the higher the silver chloride content of the silver chlorobromide emulsion used, the better is the developability of the photographic material obtained. However, a silver chlorobromide emulsion of such a high silver chloride content causes dissolution of silver into a processing solution, in particular developing solution, due to its high solubility, as a result, silver contamination is liable to be generated.

In development processing of a photographic material, an automatic developing machine (hereinafter referred to as "an automatic processor") has been often used, in general, for rapidity, easiness and handleability. In recent years, requirements for the reduction of replenishing rate of processing solutions and the increase in rapidity of development processing have increased more and more. One means for satisfying these requirements is to increase the activity of a developing solution. In the processing of a black-and-white photographic material, the activity can be heightened by increasing the concentration of a developing agent but a developing solution seriously deteriorates due to air oxidation. Thinning of the film thickness of a photographic material (e.g., a protective layer) is also effective for rapid processing.

The use of sulfites for preventing the deterioration of a developing solution has been known for long. When replenishing rate is reduced, as is conducted in recent years from the viewpoint of environmental protection, air oxidation of a developing solution further advances and it becomes difficult to maintain capabilities of a solution. As a result, it becomes necessary to use quantities of sulfites such as 0.3 mol/liter or more but as sulfite has the action of dissolving silver halide, silver is dissolved out from a photographic material into a developing solution as a sulfite silver complex. This silver complex is reduced in the developing solution and adheres to the developing tank and the roller and gradually accumulates. This is called silver contamination or silver sludge, which adheres to the photographic material to be processed and stains the image and the automatic processor, therefore, periodic cleaning and maintenance of apparatuses are necessary.

As a method of reducing such silver contamination, a method of adding compounds which decrease the amount of silver ions dissolving into a developing solution and/or suppress the reduction of silver ions to silver is known, as disclosed in JP-A-56-24347 and JP-A-8-6215. However, for obtaining the satisfactory preventing effect of silver contamination with such compounds, the addition amount of the former compounds must be increased, which largely influences photographic capabilities, such as lower sensitization, lowering of contrast (lowering of gamma value), lowering of practical density (Dmax) and increase of fog. These disadvantages are serious, in particular, in a superhigh contrast photographic material containing a hydrazine compound. As for the latter compounds, contamination of the rack and the tank of an automatic processor is certainly prevented as they have high reduction-preventing capability but, when a photographic material is practically processed, as the reduction-preventing effect at the part where the roller and the photographic material is contacted, where the silver concentration is locally high, is insufficient, the reduced silver is precipitated on the roller and adheres to the photographic material and causes silver contamination.

SUMMARY OF THE INVENTION

Accordingly, an object of the present invention is to provide a method for processing a silver halide photographic material suitable for a scanner and an image setter having an He—Ne laser, a red semiconductor laser, an LED, etc., as a light source, which process can stably provide photographic capabilities such as high sensitivity, high contrast and high Dmax even in running processing and which generates little silver sludge.

Other objects and effects of the present invention will become apparent from the following description.

The above objects of the present invention have been achieved by the following.

(1) A processing method comprising the steps of:

imagewise exposing a silver halide photographic material comprising a support having thereon at least one light-sensitive silver halide emulsion layer; and developing the exposed photographic material, wherein the development is carried out in the presence of a compound represented by formula (I):

(I)

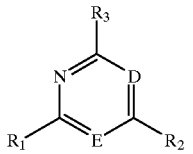

wherein D and E each represents a —CH═ group, a —C($R_0$)═ group or a nitrogen atom wherein $R_0$ represents a substituent; and $R_1$, $R_2$ and $R_3$, which may be the same or different, each represents a hydrogen atom, a halogen atom or a substituent bonded to the ring by any of a carbon atom, a nitrogen atom, an oxygen atom, a sulfur atom or a phosphorus atom, provided that at least one of $R_1$, $R_2$, $R_3$ and $R_0$ has an —SM group (wherein M represents an alkali metal atom, a hydrogen atom or an ammonium group), and when only one of E and D represents a nitrogen atom, E represents a nitrogen atom, D represents a —CH═ group or a —C($R_0$)═ group, and neither $R_2$ nor $R_3$ represents a hydroxyl group; and wherein the silver halide emulsion in the photographic material is spectrally sensitized with at least one dye represented by formula (II), (III), (IV) or (V):

(II)

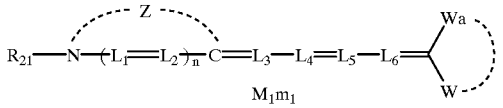

wherein $R_{21}$ represents an alkyl group; Z represents an atomic group necessary to form a 5- or 6-membered nitrogen-containing heterocyclic group; W and Wa represent atomic groups necessary to form an acyclic or cyclic acidic nucleus; $L_1$, $L_2$, $L_3$, $L_4$, $L_5$ and $L_6$ each represents a methine group; $M_1$ represents a counter ion necessary to neutralize a charge; $m_1$ represents a number of 0 or more necessary to neutralize a charge in the molecule; and n represents 0 or 1;

(III)

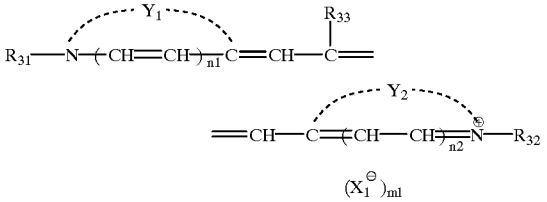

wherein $Y_1$ and $Y_2$ each represents a nonmetal atomic group necessary to form a benzothiazole ring, a benzoselenazole ring, a naphthothiazole ring, a naphthoselenazole ring or a quinoline ring, which may be substituted with a lower alkyl group, an alkoxyl group, an aryl group, a hydroxyl group, an alkoxycarbonyl group or a halogen atom; $R_{31}$ and $R_{32}$ each represents a lower alkyl group or an alkyl group having a sulfo group or a carboxyl group; $R_{33}$ represents a methyl group, an ethyl group or a propyl group; $X_1$ represents an anion; $n_1$ and $n_2$ each represents 0 or 1; and $m_1$ represents 1 or 0, and when an inner salt is formed $m_1$ represents 0;

(IV)

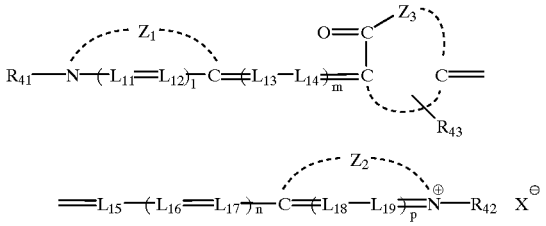

wherein $Z_1$ and $Z_2$ each represents an atomic group necessary to form a 5- or 6-membered heterocyclic ring; $Z_3$ represents an atomic group necessary to form a 5- or 6-membered nitrogen-containing heterocyclic ring, and the nitrogen atom in $Z_3$ has a substituent represented by $R_{43}$; $R_{41}$ and $R_{42}$ each represents an alkyl group, an alkenyl group, an aralkyl group or an aryl group; $R_{43}$ represents the same substituent as $R_{41}$ and $R_{42}$, or a substituted amino group, an amido group, an imino group, an alkoxyl group, an acyl group, an alkylsulfonyl group or a heterocyclic group, and at least one of $R_{41}$, $R_{42}$ and $R_{43}$ represents a water-soluble group; $L_{11}$, $L_{12}$, $L_{13}$, $L_{14}$, $L_{15}$, $L_{16}$, $L_{17}$, $L_{18}$ and $L_{19}$ each represents a methine group; m and n each represents 0, 1 or 2; 1 and p each represents 0 or 1; and X represents a counter ion;

(V)

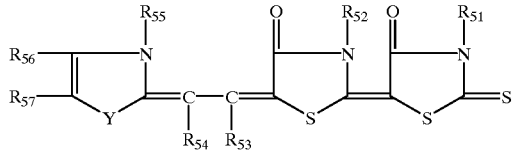

wherein Y represents —S— or —Se—; at least two of $R_{51}$, $R_{52}$, $R_{53}$, $R_{54}$ and $R_{55}$ represent an organic group having a water-soluble group, and $R_{51}$ to $R_{55}$ other than the organic group having a water-soluble group each represents a hydrogen atom, an alkyl group, a substituted alkyl group, an alkenyl group, a substituted alkenyl group, an aryl group or a substituted aryl group; and $R_{56}$ and $R_{57}$, which may be the same or different, each represents a substituted or unsubstituted alkyl, alkenyl, alkynyl, alkoxyl, alkylthio, arylthio, aryl, acyl, alkoxycarbonyl, alkylsulfonyl, carbamoyl or sulfamoyl group, a hydrogen atom, a hydroxyl group, a halogen atom, a carboxyl group or a cyano group, $R_{56}$ and $R_{57}$ may be linked to each other to form a carbocyclic ring, and the carbocyclic ring may have the same or different one or more substituents selected from the substituents defined above for $R_{56}$ and $R_{57}$.

(2) The processing method as described in the above (1), wherein at least one of the silver halide emulsion layer and other hydrophilic colloid layers contains at least one hydrazine compound.

DETAILED DESCRIPTION OF THE INVENTION

The compound represented by formula (I) is described in detail below.

Specific examples of substituents other than a hydrogen atom represented by $R_1$, $R_2$ and $R_3$ and substituents represented by $R_0$ include a halogen atom (e.g., fluorine, chlorine, bromine, iodine), an alkyl group (including an aralkyl group, a cycloalkyl group, an active methine group), an alkenyl group, an alkynyl group, an aryl group, a heterocyclic group, a heterocyclic group containing a quaternized nitrogen atom (e.g., pyridinio), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxyl group, an alkoxyl group (including a group having an ethyleneoxy group or a propyleneoxy group as a repeating unit), an aryloxy group, a heterocyclic oxy group, an acyloxy group, an alkoxy- or aryloxycarbonyloxy group, a carbamoyloxy group, a sulfonyloxy group, an amino group, an alkyl-, aryl- or heterocyclic amino group, a hydroxylamino group, an N-substituted saturated or unsaturated nitrogen-containing heterocyclic group, an acylamino group, a sulfonamido group, a ureido group, a thioureido group, an imido group, an alkoxy- or aryloxycarbonylamino group, a sulfamoylamino group, a semicarbazido group, a thiosemicarbazido group, a hydrazino group, a quaternary ammonium group, an oxamoylamino group, an alkyl- or arylsulfonylureido group, an acylureido group, an acylsulfamoylamino group, a nitro group, a mercapto group, an alkyl- aryl- or heterocyclic thio group, an alkyl- or arylsulfonyl group, an alkyl- or arylsulfinyl group, a sulfo group or a salt thereof, a sulfamoyl group, an acylsulfamoyl group, a sulfonylsulfamoyl group or a salt thereof, and a group having a phosphoric acid amide or phosphoric ester structure.

These substituents may further be substituted with these substituents.

When E represents a nitrogen atom and D represents a carbon atom (a —CH═ group or a —C($R_0$)═ group), $R_2$ and $R_3$ do not represent a hydroxyl group.

Preferred examples of the substituents other than a hydrogen atom represented by $R_1$, $R_2$ and $R_3$ and the substituents represented by $R_0$ include a substituent having from 0 to 15 carbon atoms, e.g., a chlorine atom, an alkyl group, an aryl group, a heterocyclic group, an acyl group, an alkoxycarbonyl group, a carbamoyl group, a carboxyl group or a salt thereof, a cyano group, an alkoxyl group, an aryloxy group, an acyloxy group, an amino group, an alkyl-, aryl- or heterocyclic amino group, a hydroxylamino group, an N-substituted saturated or unsaturated nitrogen-containing heterocyclic group, an acylamino group, a sulfonamido group, a ureido group, a thioureido group, a sulfamoylamino group, a nitro group, a mercapto group, an alkyl- aryl- or heterocyclic thio group, a sulfo group or a salt thereof, and a sulfamoyl group, more preferred are an alkyl group, an aryl group, a heterocyclic group, an alkoxycarbonyl group, a carbamoyl group, a carboxyl group or a salt thereof, an alkoxyl group, an aryloxy group, an acyloxy group, an amino group, an alkyl-, aryl- or heterocyclic amino group, a hydroxylamino group, an N-substituted saturated or unsaturated nitrogen-containing heterocyclic group, an acylamino group, a sulfonamido group, a ureido group, a thioureido group, a sulfamoylamino group, a mercapto group, an alkyl- aryl- or heterocyclic thio group, and a sulfo group or a salt thereof, and most preferred are an amino group, an alkyl group, an aryl group, an alkoxyl group, an aryloxy group, an alkylamino group, an arylamino group, an alkylthio group, an arylthio group, a mercapto group, a carboxyl group or a salt thereof, and a sulfo group or a salt thereof.

In formula (I), $R_1$, $R_2$, $R_3$ and $R_0$ may be linked to each other to form a condensed ring by condensation of a hydrocarbon ring, a heterocyclic ring or an aromatic ring.

In formula (I), at least one of $R_1$, $R_2$, $R_3$ and $R_0$ has an —SM group, wherein M represents an alkali metal atom, a hydrogen atom or an ammonium group. The alkali metal atom specifically includes Na, K, Li, Mg, Ca, etc., and they exist as a counter cation of —S—. M is preferably a hydrogen atom, an ammonium group, $Na^+$ or $K^+$, and particularly preferably a hydrogen atom.

The compound represented by formula (I) is preferably represented by the following formula (A) or (B).

(A)

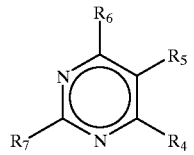

(B)

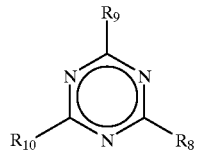

The compound represented by formula (A) is described in detail below.

$R_4$, $R_5$, $R_6$ and $R_7$ each represents a hydrogen atom, a halogen atom or any substituent which is bonded to the ring by any of a carbon atom, a nitrogen atom, an oxygen atom, a sulfur atom or a phosphorus atom. They have the same meaning with $R_1$, $R_2$ and $R_3$ in formula (I) and the preferred range of the substituent is also the same, provided that $R_4$ and $R_6$ do not represent a hydroxyl group. $R_4$ to $R_7$ may be the same or different, but at least one of them represents an —SM group. M represents a hydrogen atom, an alkali metal atom, or an ammonium group.

In formula (A), at least one of $R_4$ to $R_7$ represents an —SM group, more preferably at least two of $R_4$ to $R_7$ represent an —SM group. When at least two of $R_4$ to $R_7$ represent an —SM group, preferably $R_4$ and $R_7$, or $R_6$ and $R_7$ represent an —SM group.

In the present invention, the compound represented by formula (A) is particularly preferably represented by the following formula (A-1), (A-2) or (A-3):

(A-1)

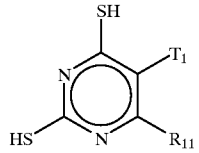

(A-2)

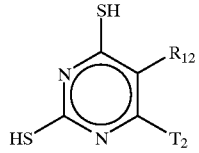

-continued (A-3)

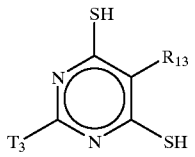

In formula (A-1), $R_{11}$ represents a mercapto group, a hydrogen atom or any substituent, and $T_1$ represents a water-soluble group or a substituent substituted with a water-soluble group. In formula (A-2), $T_2$ represents a water-soluble group or a substituent substituted with a water-soluble group, and $R_{12}$ represents a hydrogen atom or any substituent. In formula (A-3), $T_3$ represents a water-soluble group or a substituent substituted with a water-soluble group, and $R_{13}$ represents a hydrogen atom or any substituent, provided that $R_{11}$ and $T_2$ do not represent a hydroxyl group.

Compounds represented by-formulae (A-1), (A-2) and (A-3) are described in detail below.

In formula (A-1), $R_{11}$ represents a mercapto group, a hydrogen atom or any substituent.

The "any substituent" used herein includes the same substituents as described with respect to $R_4$ to $R_7$ in formula (A). $R_{11}$ preferably represents a mercapto group, a hydrogen atom, or a group selected from the following substituents having from 0 to 15 carbon atoms, e.g., an amino group, an alkyl group, an aryl group, an alkoxyl group, an aryloxy group, an acylamino group, a sulfonamido group, an alkylthio group, an arylthio group, an alkylamino group, or an arylamino group.

In formula (A-1), $T_1$ represents a water-soluble group or a substituent substituted with a water-soluble group. The water-soluble group herein is a group containing a sulfonic acid or a carboxylic acid or their salts, a salt such as an ammonio group, or a dissociative group dissociable partly or completely by an alkaline developing solution, specifically a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, or an active methine group, or a substituent containing any of these groups. The active methine group in the present invention means a methyl group substituted with two electron attractive groups, specifically dicyanomethyl, α-cyano-α-ethoxycarbonylmethyl, and α-acetyl-α-ethoxycarbonylmethyl can be cited.

The substituent represented by $T_1$ in formula (A-1) is the above-described water-soluble group, or a substituent substituted with the above-described water-soluble group, and the substituent substituted by the water-soluble group include those having from 0 to 15 carbon atoms, e.g., an alkyl group, an aryl group, a heterocyclic group, an alkoxyl group, an aryloxy group, a heterocyclic oxy group, an acyloxy group, an alkyl-, aryl- or heterocyclic amino group, an acylamino group, a sulfonamido group, a ureido group, a thioureido group, an imido group, a sulfamoylamino group, an alkyl-, aryl- or heterocyclic thio group, an alkyl- or arylsulfonyl group, a sulfamoyl group, or an amino group, preferably having from 1 to 10 carbon atoms, e.g., an alkyl group (in particular, a methyl group substituted with an amino group), an aryl group, an aryloxy group, an amino group, an alkyl-, aryl- or heterocyclic amino group, and an alkyl-, aryl- or heterocyclic thio group.

The compound represented by formula (A-1) is more preferably represented by the following formula (A-1-a):

(A-1-a)

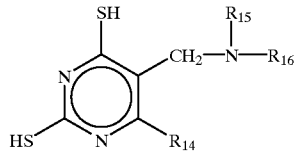

wherein $R_{14}$ has the same meaning as $R_{11}$ in formula (A-1) and the preferred range of the substituent is also the same. $R_{15}$ and $R_{16}$, which may be the same or different, each represents a hydrogen atom, an alkyl group, an aryl group, or a heterocyclic group, provided that at least one of $R_{15}$ and $R_{16}$ has at least one water-soluble group. The water-soluble group herein is a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, an active methine group, or a substituent containing any of these groups, preferably a sulfo group (or a salt thereof), a carboxyl group (or a salt thereof), a hydroxyl group, or an amino group.

$R_{15}$ and $R_{16}$ each preferably represents an alkyl group or an aryl group. When $R_{15}$ or $R_{16}$ represents an alkyl group, the alkyl group is preferably a substituted or unsubstituted alkyl group having from 1 to 4 carbon atoms, and substituents include a water-soluble group, particularly preferably a sulfo group (or a salt thereof), a carboxyl group (or a salt thereof), a hydroxyl group, or an amino group. When $R_{15}$ or $R_{16}$ each represents an aryl group, the aryl group is preferably a substituted or unsubstituted phenyl group having from 6 to 10 carbon atoms, and substituents include a water-soluble group, particularly preferably a sulfo group (or a salt thereof), a carboxyl group (or a salt thereof), a hydroxyl group, or an amino group.

When $R_{15}$ and $R_{16}$ each represents an alkyl group or an aryl group, they may be bonded to each other to form a cyclic structure, or may form a saturated heterocyclic ring by a cyclic structure.

In formula (A-2), $T_2$ represents a water-soluble group or a substituent substituted with a water-soluble group, and $T_2$ has the same meaning as $T_1$ in formula (A-1). As the water-soluble group or the substituent substituted with a water-soluble group represented by $T_2$ in formula (A-2), preferred are an active methine group, or the following group substituted with a water-soluble group, e.g., an amino group, an alkoxyl group, an aryloxy group, an alkylthio group, an arylthio group, an alkyl group, or an aryl group. $T_2$ more preferably represents an active methine group, or an alkyl-, aryl- or heterocyclic amino group substituted with a water-soluble group, and herein as a water-soluble group, a hydroxyl group, a carboxyl group or a salt thereof, or a sulfo group or a salt thereof is particularly preferred.

Particularly preferred as $T_2$ is an alkyl-, aryl- or heterocyclic amino group substituted with a hydroxyl group, a carboxyl group (or a salt thereof), or a sulfo group (or a salt thereof), which is represented by an —$N(R_{01})(R_{02})$ group. $R_{01}$ and $R_{02}$ each has the same meaning as $R_{15}$ and $R_{16}$ in formula (A-1-a) and the preferred range of the substituent is also the same.

In formula (A-2), $R_{12}$ represents a hydrogen atom or any substituent, and the "any substituent" herein includes the same substituents as described with respect to $R_4$ to $R_7$ in formula (A). $R_{12}$ preferably represents a hydrogen atom or a group selected from the following substituents having from 0 to 15 carbon atoms, e.g., a hydroxyl group, an amino group, an alkyl group, an aryl group, an alkoxyl group, an aryloxy group, an acylamino group, a sulfonamido group, an alkylthio group, an arylthio group, an alkylamino group, an arylamino group, or a hydroxylamino group. $R_{12}$ most preferably represents a hydrogen atom.

In formula (A-3), $T_3$ represents a water-soluble group or a substituent substituted with a water-soluble group, and $R_{13}$ represents a hydrogen atom or any substituent. $T_3$ and $R_{13}$ in formula (A-3) have the same meaning as $T_2$ and $R_{12}$ in formula (A-2), and the preferred ranges of the substituents are also the same.

The compound represented by formula (B) is described in detail below.

$R_8$, $R_9$ and $R_{10}$ in formula (B) have the same meaning as $R_4$ to $R_7$ in formula (A), and the preferred ranges of the substituents are also the same. The compound represented by formula (B) is particularly preferably represented by formula (B-1).

(B-1)

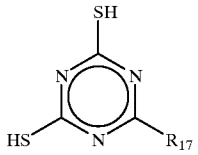

wherein $R_{17}$ has the same meaning as $R_8$ to $R_{10}$ in formula (B), more preferably $R_{17}$ is the same water-soluble group or the substituent substituted with a water-soluble group represented by $T_1$, $T_2$ and $T_3$ in formulae (A-1), (A-2) and (A-3). The compound represented by formula (B-1) is most preferably represented by formula (B-1-a).

(B-1-a)

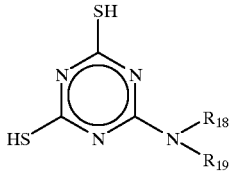

wherein $R_{18}$ and $R_{19}$ have the same meaning as $R_{15}$ and $R_{16}$ in formula (A-1-a) and the preferred ranges of the substituents are also the same.

Specific examples of the compounds represented by formula (I) according to the present invention are shown below but it should not be construed as the present invention is limited thereto.

I-1

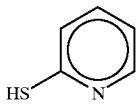

-continued

I-2

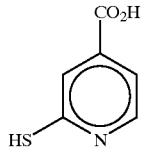

I-3

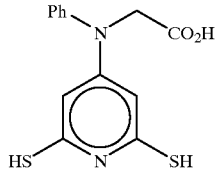

I-4

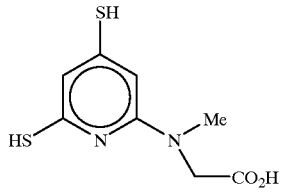

I-5

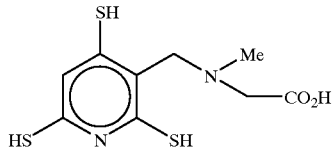

I-6

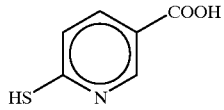

I-7

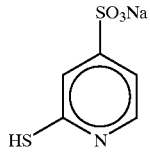

I-8

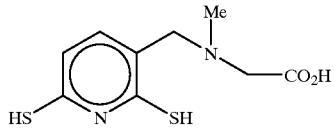

I-9

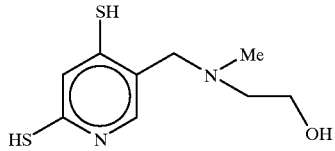

I-10

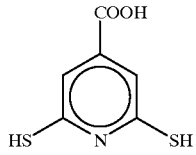

-continued
I-11
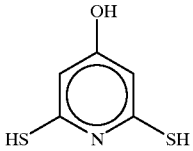
I-12
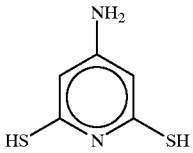
I-13
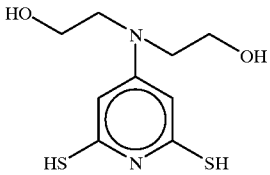
I-14
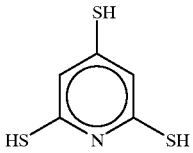
I-15
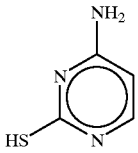
I-16
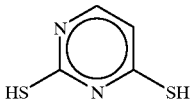
I-17
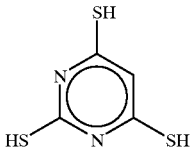
I-18
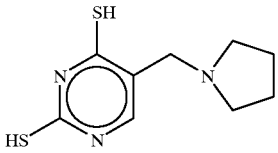
I-19
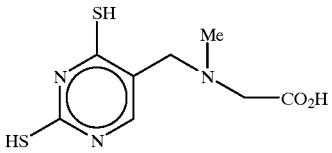
-continued
I-20
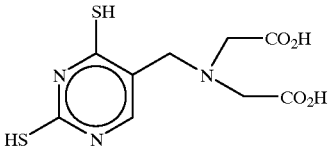
I-21
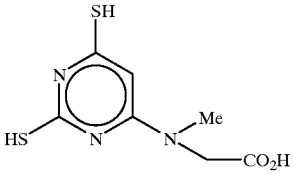
I-22
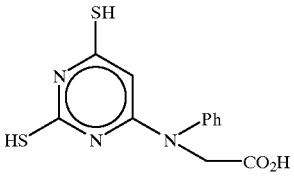
I-23
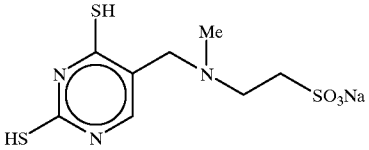
I-24
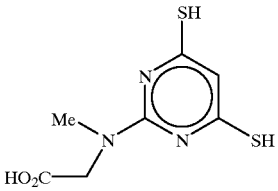
I-25
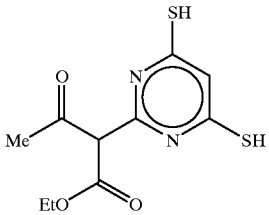
I-26
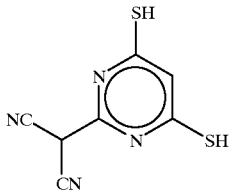

-continued
I-27
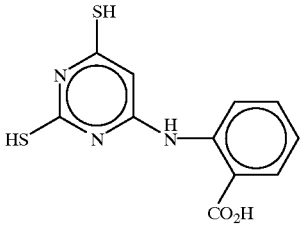
I-28
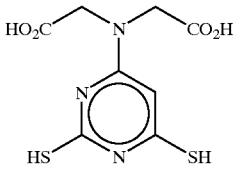
I-29
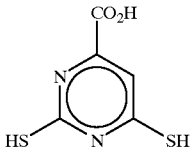
I-30
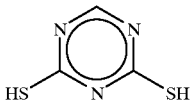
I-31
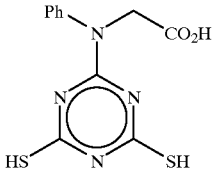
I-32
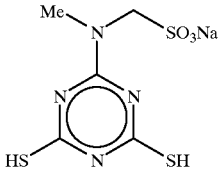
I-33
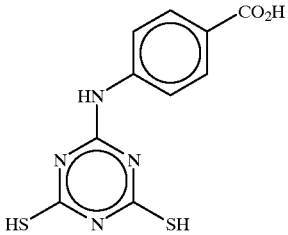
I-34
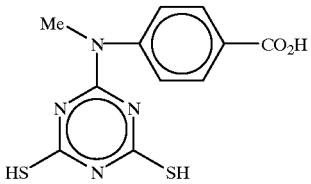
-continued
I-35
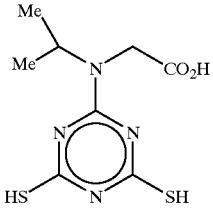
I-36
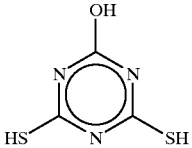
I-37
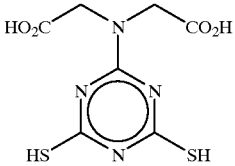
I-38
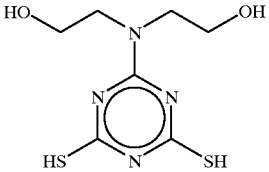
I-39
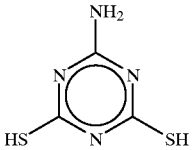
I-40
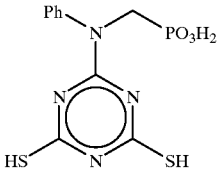
I-41
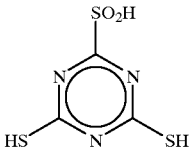
I-42
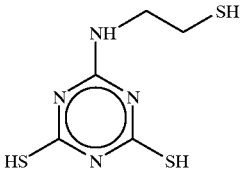

-continued

I-43

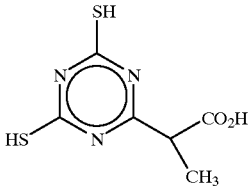

I-44

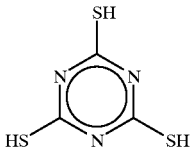

I-45

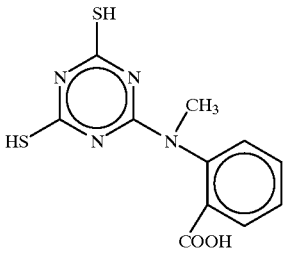

I-46

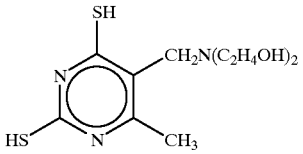

I-47

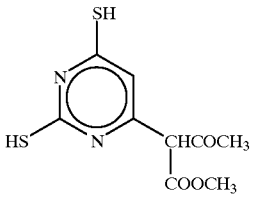

I-48

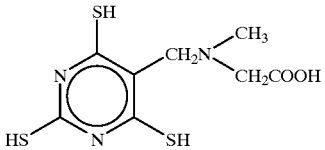

I-49

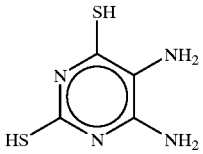

I-50

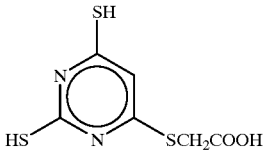

-continued

I-51

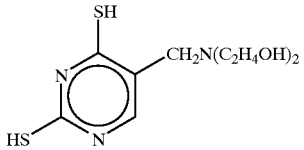

I-52

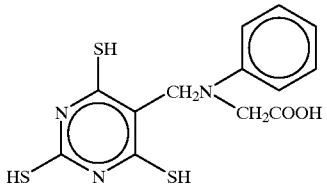

I-53

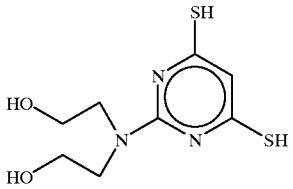

I-54

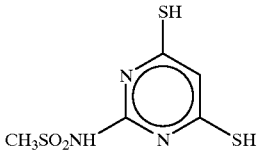

The compound represented by formula (I) is generally used in an amount of from 0.01 to 10 mmol, preferably from 0.1 to 5 mmol, per liter of the developing solution (the working solution). When the compound is added to a photographic material, the amount is from 2 to 500 mg/m$^2$, preferably from 5 to 250 mg/m$^2$.

The silver halide photographic material for use in the present invention is spectrally sensitized with at least one dye selected from the dyes represented by the following formulae (II), (III), (IV) and (V).

The compound represented by formula (II) is described in detail below.

In formula (II), $R_{21}$ represents an alkyl group; Z represents an atomic group necessary to form a 5- or 6-membered nitrogen-containing heterocyclic group; W and Wa each represents an atomic group necessary to form an acyclic or cyclic acidic nucleus; $L_1$, $L_2$, $L_3$, $L_4$, $L_5$ and $L_6$ each represents a methine group; $M_1$ represents a counter ion necessary to neutralize a charge; $m_1$ represents a number of 0 or more necessary to neutralize a charge in the molecule; and n represents 0 or 1.

$R_{21}$ preferably represents an alkyl group or a substituted alkyl group having 8 or less carbon atoms (examples of substituents include, e.g., a carboxyl group, a sulfo group, a cyano group, a halogen atom, a hydroxyl group, an alkoxycarbonyl group, an alkenesulfonylaminocarbonyl group, an alkoxyl group, an alkylthio group, an arylthio group, an aryloxy group, an acyloxy group, an acylthio group, an acyl group, a carbamoyl group, a sulfamoyl group and an aryl group), more preferably an unsubstituted alkyl group, a carboxyalkyl group, a sulfoalkyl group or a methanesulfonylcarbamoylmethyl group.

Examples of nuclei formed by Z include a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a tellurazole nucleus, a benzotellurazole nucleus, a naphthotellurazole nucleus, a tellurazoline nucleus, a 3,3-dialkylindolenine nucleus, an imidazole nucleus, a benzimidazole nucleus, a naphthoimidazole nucleus, a pyridine nucleus, a quinoline nucleus, an isoquinoline nucleus, an imidazo[4,5-b]quinoxaline nucleus, an oxadiazole nucleus, a thiadiazole nucleus, a tetrazole nucleus, and a pyrimidine nucleus, preferably a benzothiazole nucleus, a naphthothiazole nucleus, a benzoxazole nucleus, a naphthoxazole nucleus, a 2-quinoline nucleus and a 4-quinoline nucleus.

W and Wa represent atomic groups necessary to form an acidic nucleus and the acidic nucleus can take any form of common merocyanine dyes. The acidic nucleus used in the present invention is defined, for example, by James, *The Theory of the Photographic Process,* 4th Ed., p. 198, Macmillan (1977). Substituents which are concerned with the resonance of W in preferred form include, e.g., a carbonyl group, a cyano group, a sulfonyl group, and a sulphenyl group. Wa represents the remaining atomic group necessary to form an acidic nucleus. Specifically, those disclosed in U.S. Pat. Nos. 3,567,719, 3,575,869, 3,804,634, 3,837,862, 4,002,480, 4,925,777 and JP-A-3-167546 can be cited.

Preferred examples are 2-thiohydantoin, 2-oxazolin-5-one and rhodanine nuclei.

$L_1$, $L_2$, $L_3$, $L_4$, $L_5$ and $L_6$ each represents a methine group or a substituted methine group (e.g., a methine group substituted with a substituted or unsubstituted alkyl group, a substituted or unsubstituted aryl group, a heterocyclic group, a halogen atom, an alkoxyl group, an amino group, an alkylthio group) and they can form a ring with other methine groups or an auxochrome.

$M_1$ and $m_1$ are included in the formula to show the presence or absence of a cation or an anion when a counter ion is necessary for neutralizing an ionic charge in the molecule of the dye.

The compound represented by formula (II) is more preferably represented by formula (II-a):

(II-a)

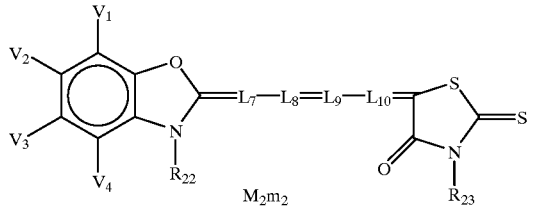

wherein $R_{22}$ and $R_{23}$ each represents an alkyl group having a group which imparts water solubility to the compound. As groups which imparts water solubility, there can be cited preferably a sulfo group (or a salt thereof), a carboxyl group (or a salt thereof), a hydroxyl group, a mercapto group, an amino group, an acylamino group, an ammonio group, a sulfonamido group, an acylsulfamoyl group, a sulfonylsulfamoyl group and the like, and particularly preferably a sulfo group (or a salt thereof), a carboxyl group (or a salt thereof), a hydroxyl group, and an acylamino group.

$V_1$, $V_2$, $V_3$ and $V_4$ each represents a hydrogen atom or a monovalent substituent, provided that $V_1$, $V_2$, $V_3$ and $V_4$ do not form a ring with each other and the total of the molecular weights of $V_1$, $V_2$, $V_3$ and $V_4$ is 100 or less.

$L_7$, $L_8$, $L_9$ and $L_{10}$ each represents a methine group.

$M_2$ represents a counter ion necessary to neutralize a charge, and $m_2$ represents a number of 0 or more necessary to neutralize a charge in the molecule.

Representative examples of the compounds represented by formula (II) or (II-a) are shown below, but the present invention is not limited thereto.

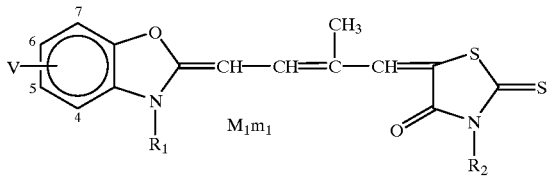

| Cpd. No. | $R_1$ | $R_2$ | V | $M_1$ | $m_1$ |
|---|---|---|---|---|---|
| II-1 | $(CH_2)_2SO_3^-$ | $CH_2CO_2$ | H | $Na^+$ | 2 |
| II-2 | " | " | " | $K^+$ | " |
| II-3 | " | " | " | $(C_2H_5)_3\overset{+}{N}H$ | " |
| II-4 | $(CH_2)_4SO_3^-$ | " | " | " | " |
| II-5 | $(CH_2)_3SO_3^-$ | " | " | " | " |
| II-6 | $(CH_2)_2CH(CH_3)SO_3^-$ | " | " | " | " |
| II-7 | $(CH_2)_4SO_3^-$ | " | 5-$OCH_3$ | " | " |
| II-8 | " | " | 5-F | $Na^+$ | " |
| II-9 | $(CH_2)_2SO_3^-$ | " | 5-$CH_3$ | " | " |
| II-10 | " | " | 5,6-$(CH_3)_2$ | " | " |
| II-11 | $(CH_2)_4SO_3^-$ | $(CH_2)_2SO_3^-$ | H | $K^+$ | " |
| II-12 | $CH_2CO_2^-$ | $CH_2CO_2^-$ | " | $Na^+$ | " |
| II-13 | $CH_2CO_2^-$ | $(CH_2)_2SO_3$ | " | " | " |
| II-14 | $(CH_2)_3CO_3^-$ | " | " | " | " |

-continued
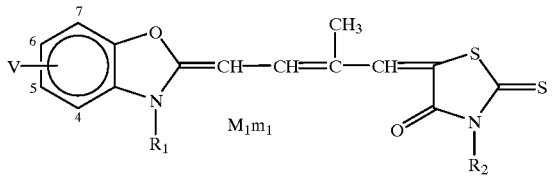
| Cpd. No. | $R_1$ | $R_2$ | V | $M_1$ | $m_1$ |
|---|---|---|---|---|---|
| II-15 | $(CH_2)_4SO_3^-$ | $(CH_2)_2OH$ | " | $K^+$ | 1 |
| II-16 | " | $(CH_2)_2CO_2^-$ | " | " | 2 |
| II-17 | " | $(CH_2)_3CO_2^-$ | " | " | " |
| II-18 | " | $(CH_2)_5CO_2^-$ | " | " | " |
| II-19 | " | $(CH_2)_2NHC(=O)CH_3$ | " | " | 1 |
| II-20 | 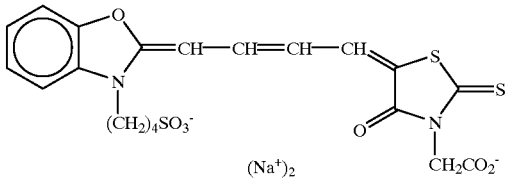 | | | | |
| II-21 | 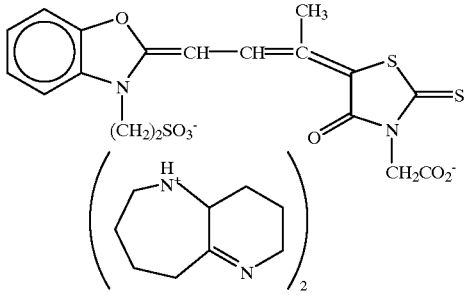 | | | | |
| II-22 | 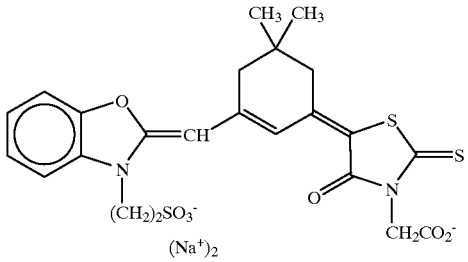 | | | | |
| II-23 | 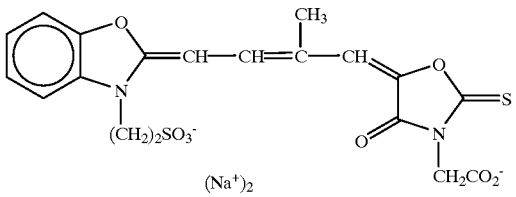 | | | | |

-continued
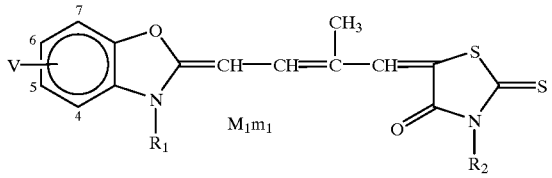
| Cpd. No. | $R_1$ | $R_2$ | V | $M_1$ | $m_1$ |
|---|---|---|---|---|---|
| II-24 | 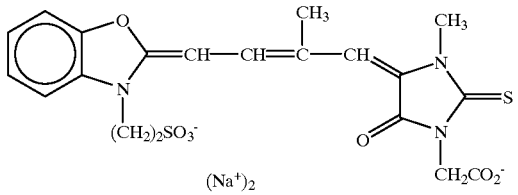 | | | | |
| II-25 | 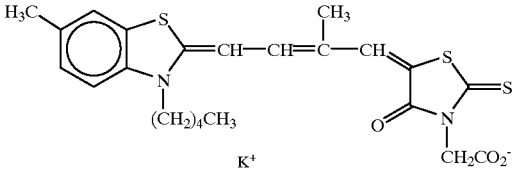 | | | | |
| II-26 | 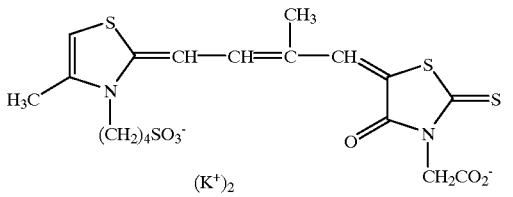 | | | | |
| II-27 | 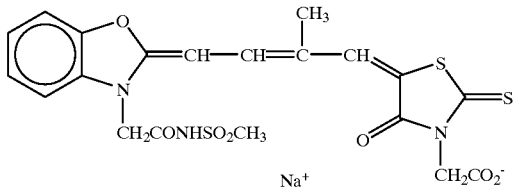 | | | | |
| II-28 | 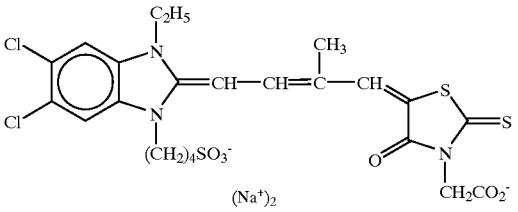 | | | | |
| II-29 | 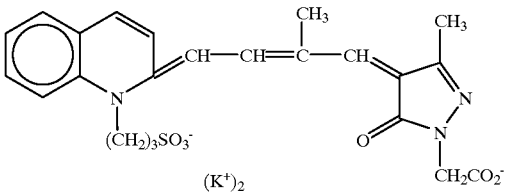 | | | | |

-continued

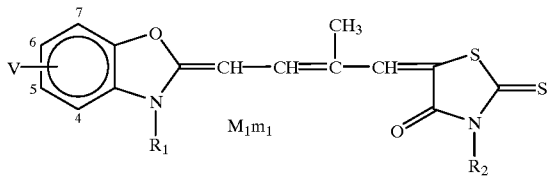

| Cpd. No. | $R_1$ | $R_2$ | V | $M_1$ | $m_1$ |
|---|---|---|---|---|---|
| II-30 | 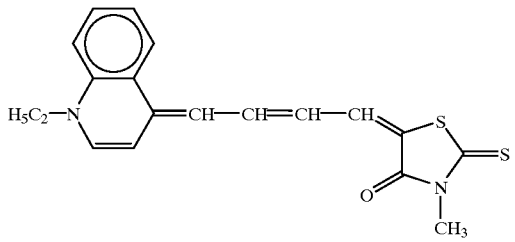 | | | | |
| II-31 | 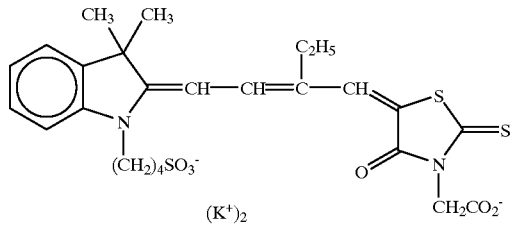 | | | | |
| II-32 | 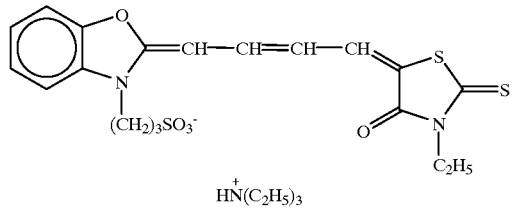 | | | | |
| II-33 | 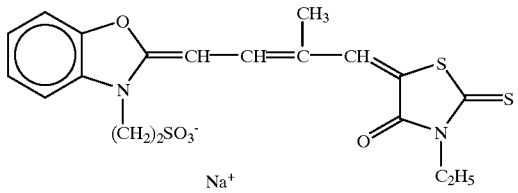 | | | | |
| II-34 | 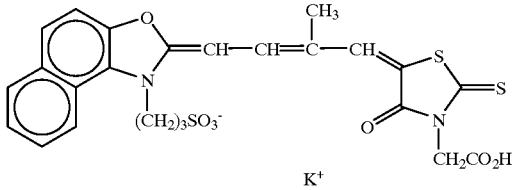 | | | | |

The compound represented by formula (III) is described in detail below.

In formula (III), $Y_1$ and $Y_2$ each represents a nonmetal atomic group necessary to form a benzothiazole ring, a benzoselenazole ring, a naphthothiazole ring, a naphthoselenazole ring, or a quinoline ring, and these heterocyclic rings may be substituted with a lower alkyl group, an alkoxyl group, an aryl group, a hydroxyl group, an alkoxycarbonyl group or a halogen atom; $R_{31}$ and $R_{32}$ each represents a lower alkyl group, or an alkyl group having a sulfo group or a carboxyl group; $R_{33}$ represents a methyl group, an ethyl group or a propyl group; $X_1$ represents an anion; $n_1$ and $n_2$ each represents 0 or 1; and $m_1$ represents 1 or 0, and when an inner salt is formed ml represents 0.

The compound represented by formula (III) is described in further detail below.

In formula (III), $Y_1$ and $Y_2$ each represents a nonmetal atomic group necessary to form a benzothiazole ring, a benzoselenazole ring, a naphthothiazole ring, a naphthoselenazole ring, or a quinoline ring, and these heterocyclic rings may be substituted with a lower alkyl group (e.g., methyl, ethyl), an alkoxyl group (e.g., methoxy, ethoxy), a hydroxyl group, an aryl group (e.g., phenyl), an alkoxycarbonyl group (e.g., methoxycarbonyl), or a halogen atom (e.g., chlorine, bromine). $R_{31}$ and $R_{32}$ each represents a lower alkyl group (e.g., methyl, ethyl, propyl, butyl), an alkyl group having a sulfo group (e.g., β-sulfoethyl, γ-sulfopropyl, γ-sulfobutyl, δ-sulfobutyl, sulfoalkoxyalkyl (e.g., sulfoethoxyethyl, sulfopropoxyethyl)), or an alkyl group having a carboxyl group (e.g., β-carboxyethyl, γ-carboxypropyl, γ-carboxybutyl, δ-carboxybutyl). $R_{33}$ represents a methyl group, an ethyl group or a propyl group. $X_1$ represents an anion usually used in cyanine dyes (e.g., a halogen ion, a benzenesulfonate ion, a p-toluenesulfonate ion). $m_1$ represents 1 or 0, and when an inner salt is formed $m_1$ represents 0.

Specific examples of the compounds represented by formula (III) are shown below, but the present invention is not limited thereto.

III-1

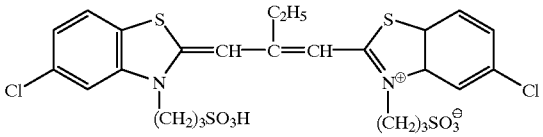

III-2

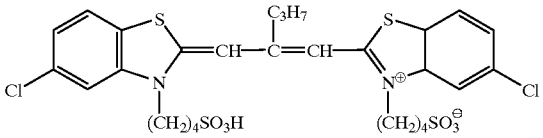

III-3

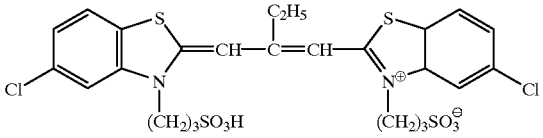

III-4

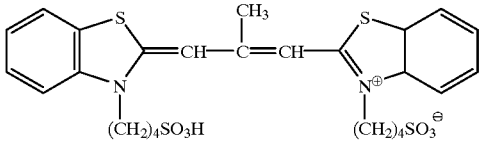

III-5

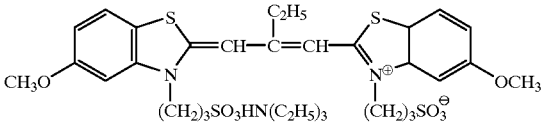

III-6

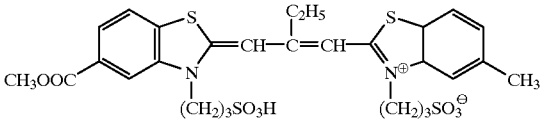

III-7

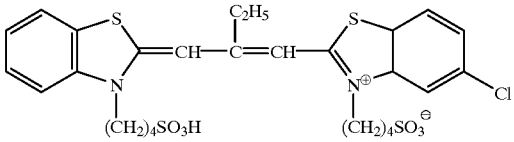

-continued

III-8

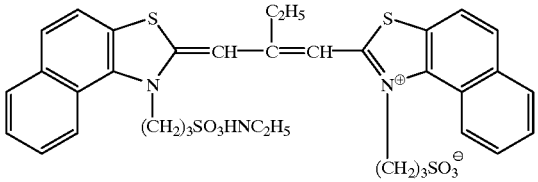

III-9

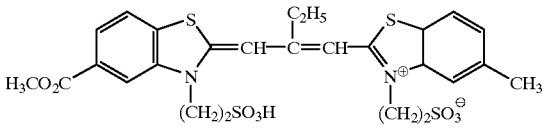

III-10

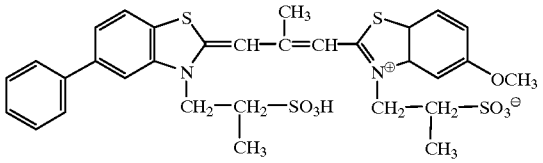

III-11

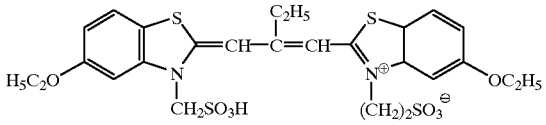

III-12

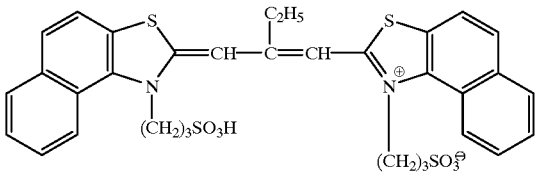

III-13

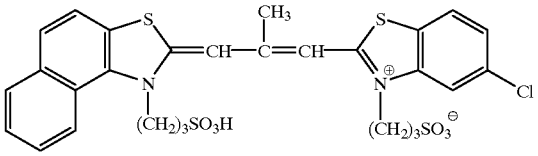

III-14

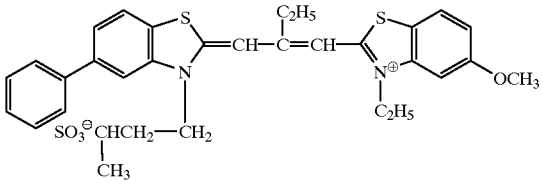

III-15

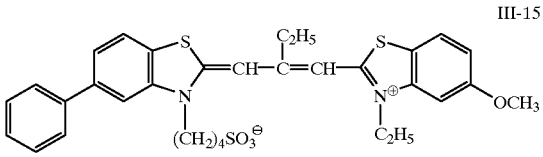

III-16

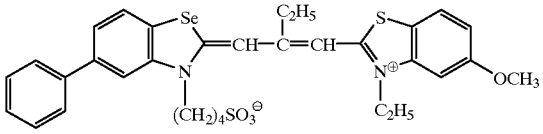

-continued
III-17
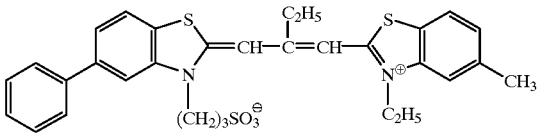
III-18
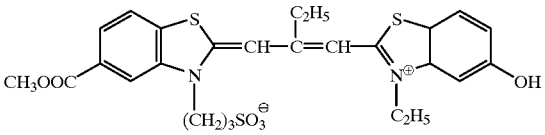
III-19
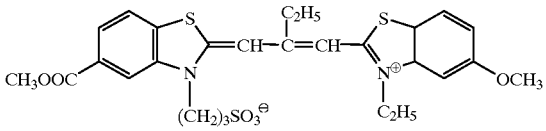
III-20
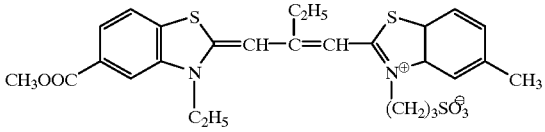
III-21
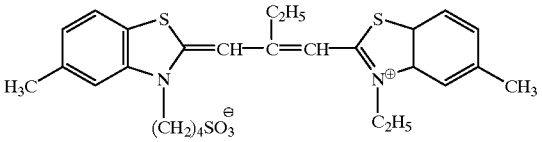
III-22
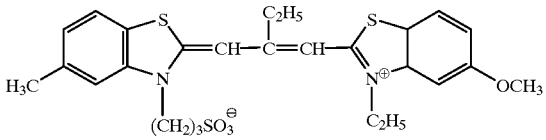
III-23
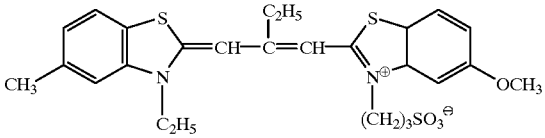
III-24
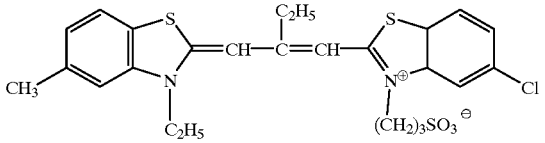
III-25
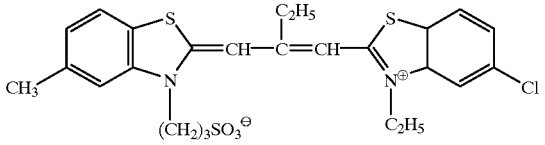
III-26
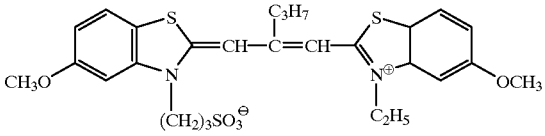
-continued
III-27
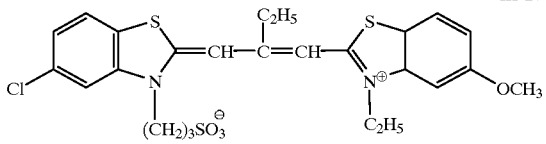
III-28
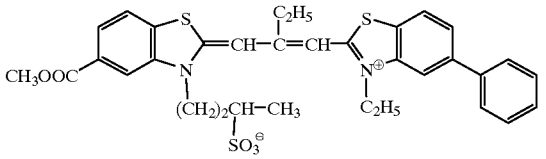
III-29
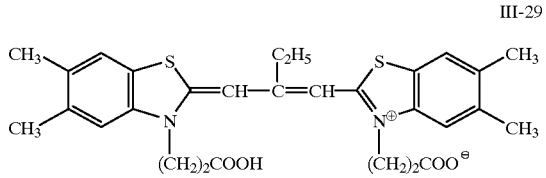
III-30
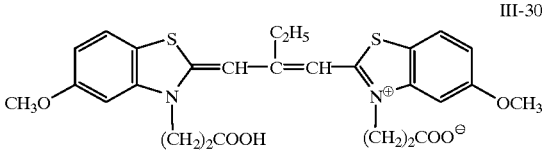
III-31
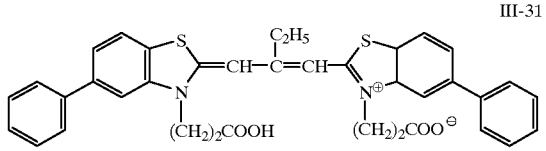
III-32
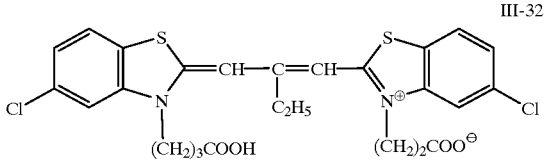
III-33
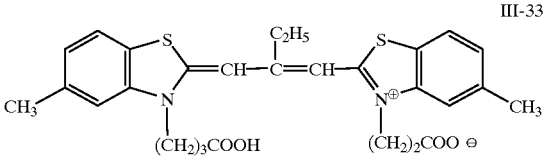
III-34
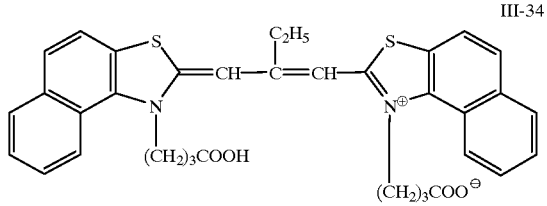
III-35
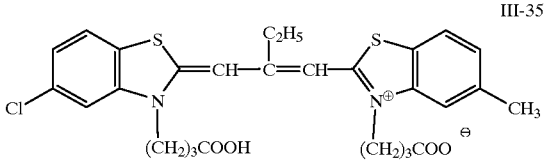

-continued

III-36

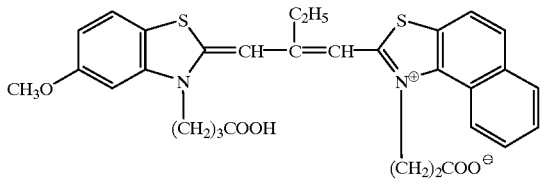

III-37

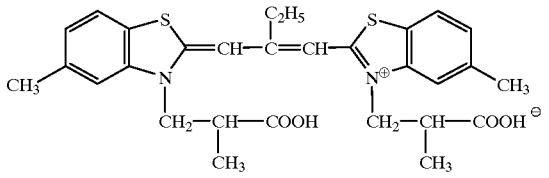

The compound represented by formula (IV) is described in detail below.

In formula (IV), $Z_1$ and $Z_2$ each represents an atomic group necessary to form a heterocyclic ring; $Z_3$ represents an atomic group necessary to form a nitrogen-containing heterocyclic ring, and the nitrogen atom in $Z_3$ has a substituent ($R_{43}$); $R_{41}$ and $R_{42}$ each represents an alkyl group, an alkenyl group, an aralkyl group or an aryl group; $R_{43}$ represents the same substituent as the substituent represented by $R_{41}$ and $R_{42}$, or a substituted amino group, an amido group, an imino group, an alkoxyl group, an acyl group, an alkylsulfonyl group or a heterocyclic group, and at least one of $R_{41}$, $R_{42}$ and $R_{43}$ represents a water-soluble group; $L_{11}$ to $L_{19}$ each represents a methine group; m and n each represents 0, 1 or 2; l and p each represents 0 or 1; and X represents a counter ion.

The heterocyclic ring formed by $Z_1$ and $Z_2$ in formula (IV) includes oxazoline, oxazole, benzoxazole, benzisooxazole, naphthoxazole, thiazoline, thiazole, benzothiazole, naphthothiazole, selenazoline, selenazole, benzoselenazole, naphthoselenazole, tellurazole, benzotellurazole, pyridine, quinoline, benzoquinoline, indolenine, benzindolenine, benzimidazole or pyrroline ring.

These heterocyclic rings may be substituted with known substituents, e.g., alkyl, alkoxyl, aryl, hydroxyl, carboxyl, alkoxycarbonyl, and halogen can be cited as such substituents.

The 5- or 6-membered nitrogen-containing heterocyclic ring formed by $Z_3$ is preferably a heterocyclic ring obtained by eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, more preferably eliminating an oxo group or a thioxo group from hydantoin, 2- or 4-thiohydantoin, 2-oxazolin-5-one, rhodanine, barbituric acid, or 2-thiobarbituric acid, and particularly preferably eliminating an oxo group or a thioxo group from 2- or 4-thiohydantoin, 2-oxazolin-5-one, or rhodanine.

The alkyl group represented by $R_{41}$, $R_{42}$ and $R_{43}$ is preferably an alkyl group having from 1 to 6 carbon atoms, which may be straight chain, branched or cyclic. The alkyl group may have a substituent, e.g., methyl, ethyl, isopropyl, cyclohexyl, allyl, trifluoromethyl, β-hydroxyethyl, acetoxymethyl, carboxymethyl, ethoxycarbonylmethyl, β-methoxyethyl, γ-methoxypropyl, β-benzoyloxyethyl, γ-sulfopropyl, or δ-sulfobutyl.

The alkenyl group represented by $R_{41}$, $R_{42}$ and $R_{43}$ is, e.g., allyl, the aralkyl group is, e.g., benzyl, phenethyl or sulfobenzyl, and the aryl group is, e.g., phenyl, tolyl, chlorophenyl or sulfophenyl.

Further, the groups bonded to a nitrogen atom among the groups represented by $R_{43}$ include, e.g., alkyl, alkenyl, aralkyl, aryl, acyl, alkylsulfonyl or heterocyclic ring, and they may be bonded by a double bond or may form a ring. Examples of the substituents represented by $R_{43}$ include, e.g., dimethylamino, diethylamino, N-methylanilino, 1-piperidino, 1-morpholino, N-methyl-2-pyridinoamino, benzylideneimino, dibenzylamino, N-acetylmethylamino, benzylamino, acetamino, N-methylsulfonylamino, N-methylureido, and 3-methylbenzothiazolideneimino, and as alkoxyl groups, e.g., methoxy and ethoxy.

At least one of $R_{41}$, $R_{42}$ and $R_{43}$ has at least one water-soluble group. The water-soluble group herein is a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, an active methine group, or a substituent containing any of these groups, preferably a sulfo group (or a salt thereof), a carboxyl group (or a salt thereof), a hydroxyl group, or an amino group.

X represents a counter ion and when an inner salt can be formed, X is absent. When two acid radicals (e.g., sulfo, sulfate, carboxyl) are present in the molecule, X represents a cation, such as an alkali metal atom or organic ammonium.

$L_{11}$ to $L_{19}$ each represents a methine group, which may be substituted with an alkyl, aryl or alkoxyl group.

Specific examples of the compounds represented by formula (IV) are shown below, but the present invention is not limited thereto.

IV-1

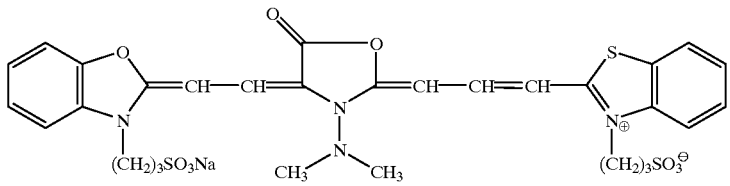

-continued
IV-2
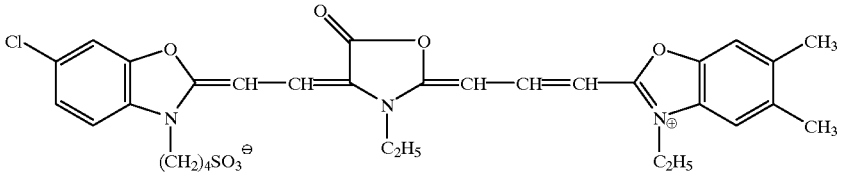
IV-3
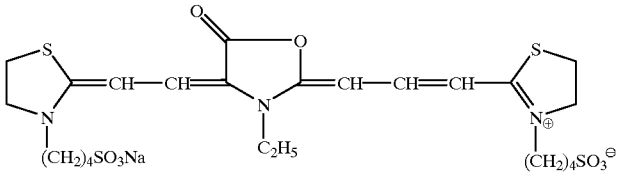
IV-4
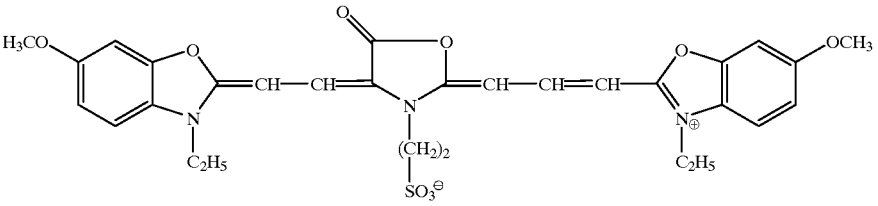
IV-5
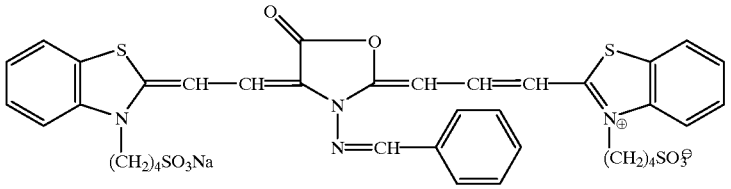
IV-6
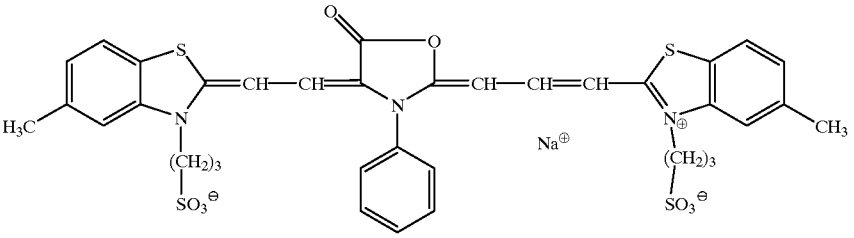
IV-7
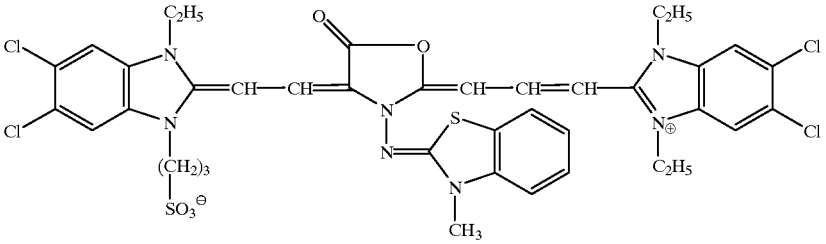
IV-8
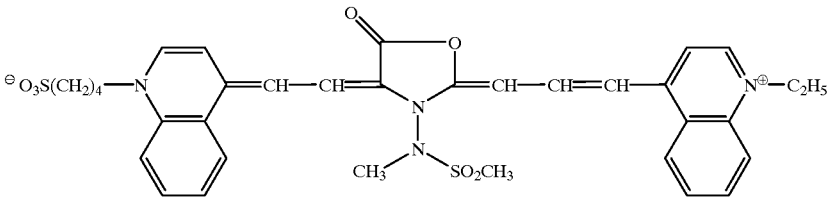

-continued
IV-9
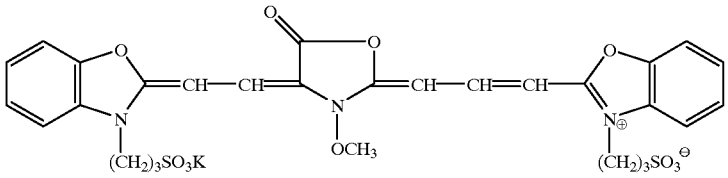
IV-10
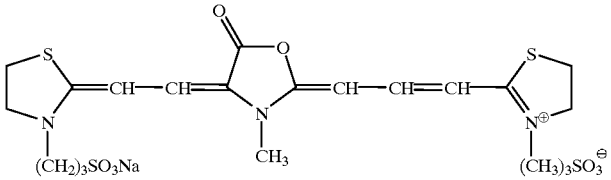
IV-11
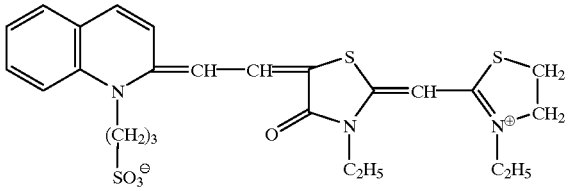
IV-12
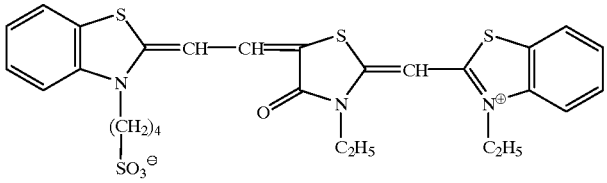
IV-13
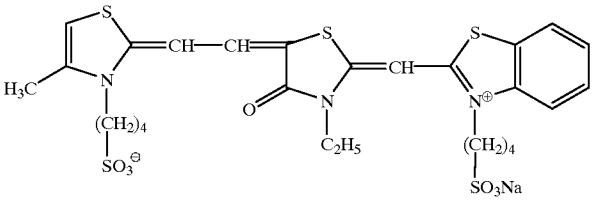
IV-14
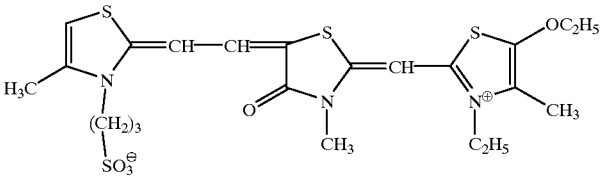
IV-15
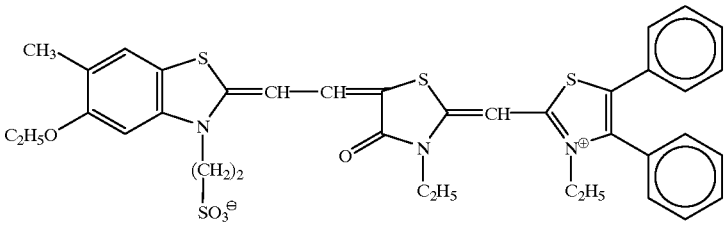

-continued
IV-16
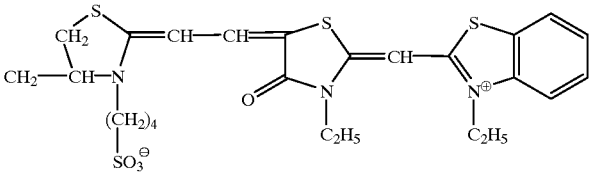
IV-17
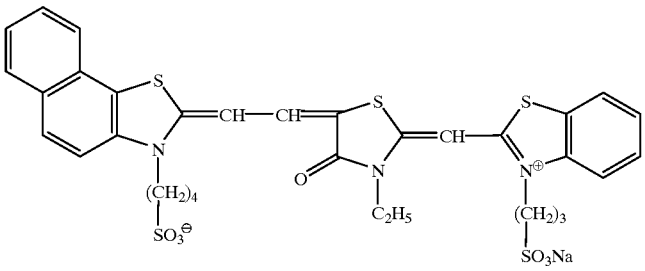
IV-18
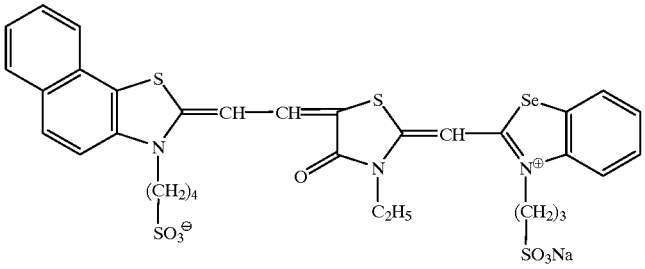
IV-19
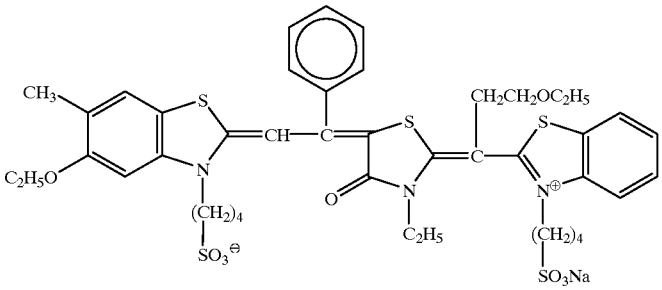
IV-20
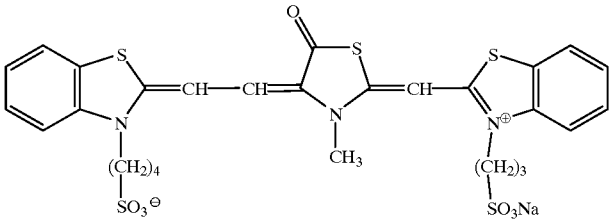

-continued

IV-21

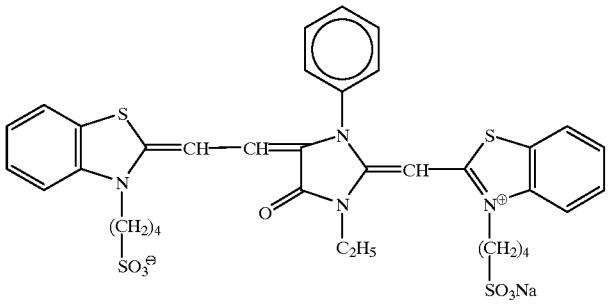

The compound represented by formula (V) is described in detail below.

In formula (V), Y represents —S— or —Se—; at least two of $R_{51}$, $R_{52}$, $R_{53}$, $R_{54}$ and $R_{55}$ represent an organic group having a water-soluble group, and $R_{51}$ to $R_{55}$ which do not represent the organic group having a water-soluble group each represents a hydrogen atom, an alkyl group, a substituted alkyl group, an alkenyl group, a substituted alkenyl group, an aryl group or a substituted aryl group; and $R_{56}$ and $R_{57}$, which may be the same or different, each represents an alkyl group, an alkenyl group, an alkynyl group, an alkoxyl group, an alkylthio group, an arylthio group, an aryl group, an acyl group, an alkoxycarbonyl group, an alkylsulfonyl group, a carbamoyl group, or a sulfamoyl group, each of which may be substituted or unsubstituted, a hydrogen atom, a hydroxyl group, a halogen atom, a carboxyl group or a cyano group, $R_{56}$ and $R_{57}$ may be linked to each other to complete a carbocyclic ring, and the carbocyclic ring may carry the same or different one or more substituents selected from the substituents described above for $R_{56}$ and $R_{57}$.

The "water-soluble group" used in the present invention means a water-soluble group having a negative π value of Hansch method which is used in correlation of the structure and activity seizing the relationship between the structure and the physiological activity of a compound. Hansch method is described in detail in *J. Med. Chem.,* 16, 1207 (1973), and ibid., 20, 304 (1979).

The sensitizing dye represented by formula (II), (III), (IV) or (V) preferably has 2 or 3 water-soluble groups.

Examples of the above-described organic groups having a water-soluble group are shown below, but the present invention is not limited to them. That is, the organic group having a water-soluble group is selected from $—(CH_2)_n—COOM$, $—C_2H_4—COOM$, $—CH_2—C_2H_4—COOM$, $—(CH_2)_n—SO_3M$, $—C_2H_4—SO_3M$, $—CH_2—C_2H_4—SO_3M$, $—CH_2—COO—CH_2—COO—R_{58}$ and $—CH_2—COO—C_2H_4—COO—R_{58}$, wherein n represents an integer of from 1 to 4, M represents hydrogen, ammonium, an alkali metal atom or an organic amine salt, and $R_{58}$ represents an alkyl group.

$R_{51}$ to $R_{55}$ which do not represent the organic group having a water-soluble group each represents a hydrogen atom, an alkyl group (e.g., methyl, ethyl), a substituted alkyl group, an alkenyl group, a substituted alkenyl group, an aryl group (e.g., phenyl) or a substituted aryl group (e.g., p-tolyl).

In formula (V), $R_{56}$ and $R_{57}$, which may be the same or different, each represents a hydrogen atom, a hydroxyl group, a halogen atom, an alkyl group (e.g., methyl, ethyl, propyl), a substituted alkyl group (e.g., trifluoromethyl, 2,2,2-trifluoroethyl), an alkenyl group (e.g., allyl), a substituted alkenyl group, an alkoxyl group (e.g., methoxy, ethoxy), an alkylthio group (e.g., ethylthio), a substituted alkylthio group, an arylthio group (e.g., phenylthio), a substituted arylthio group, an aryl group (e.g., phenyl), a substituted aryl group (e.g., p-tolyl), an acyl group (e.g., acetyl, propionyl), an acyloxy group (e.g., acetoxy, propionyloxy), an alkoxycarbonyl group (e.g., methoxycarbonyl), an alkylsulfonyl group (e.g., methylsulfonyl), a carbamoyl group, a substituted carbamoyl group, a sulfamoyl group, a substituted sulfamoyl group, a carboxyl group, or a cyano group. Further, $R_{56}$ and $R_{57}$, which may be the same or different, each represents an atom necessary to form a carbocyclic ring together, e.g., a benzene or naphthalene ring, and the carbocyclic ring may have one or more substituents selected from the substituents described above for $R_{56}$ and $R_{57}$.

Specific examples of the compounds represented by formula (V) are shown below, but the present invention is not limited thereto.

V-1

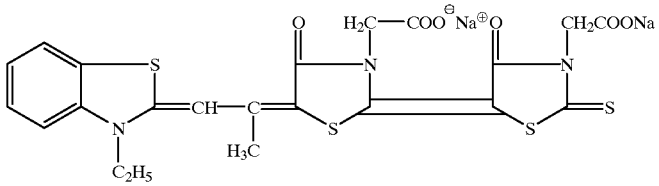

-continued

V-2

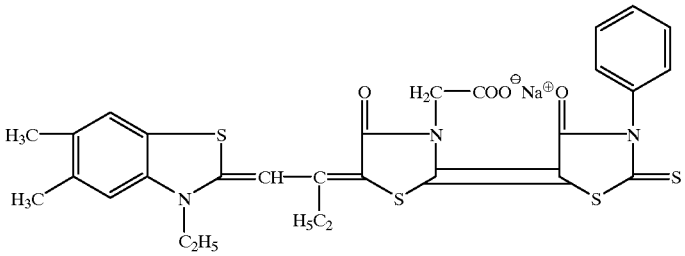

V-3

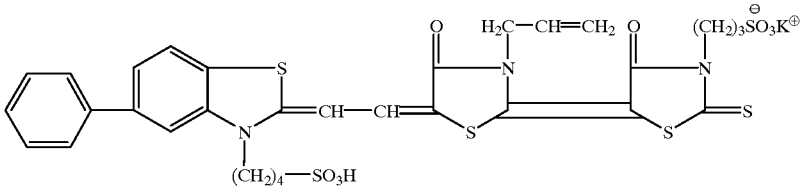

V-4

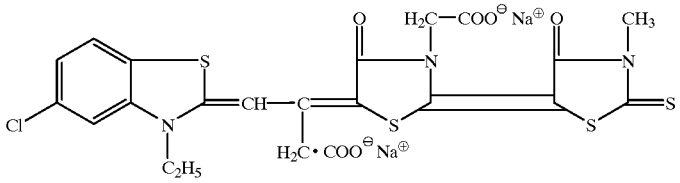

V-5

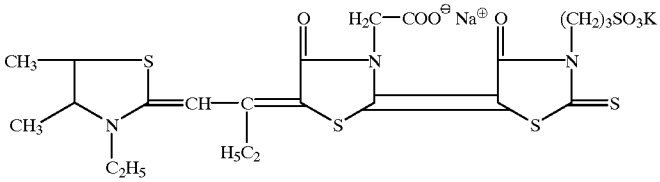

V-6

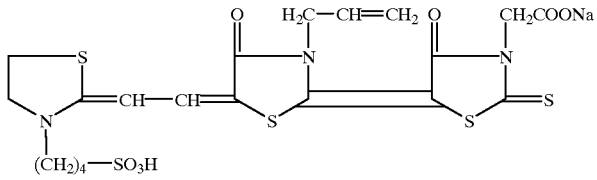

Compounds represented by formulae (II) to (V) can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, John Wiley & Sons, New York, London (1977), *Rodd's Chemistry of Carbon Compounds,* 2nd Ed., Vol. IV, Part B, Chap. 15, pp. 369 to 422, Elsevier Science Publishing Company Inc., New York (1977) and the like.

These sensitizing dyes may be used either alone or in combination of them, and a combination of sensitizing dyes is often used, in particular, for the purpose of supersensitization. There may be contained in an emulsion together with sensitizing dyes a dye having no spectral sensitizing function by itself or a material which does not substantially absorb visible light but shows supersensitization.

Combinations of useful sensitizing dyes and dyes showing supersensitization and materials showing supersensitization are disclosed in *Research Disclosure* Vol. 176, No. 17643, page 23, Item IV-J (December, 1978), JP-B-49-25500 (the term "JP-B" as used herein means an "examined Japanese patent publication"), JP-B-43-4933, JP-A-59-19032 and JP-A-59-192242.

The sensitizing dyes for use in the present invention may be used in combination of two or more thereof. For the inclusion of the sensitizing dyes in a silver halide emulsion, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., then added to the emulsion.

Further, various methods can be used for including sensitizing dyes in an emulsion. For example, a method in which sensitizing dyes are dissolved in a volatile organic solvent, the solution is dispersed in water or hydrophilic colloid and this dispersion is added to an emulsion as disclosed in U.S. Pat. No. 3,469,987, a method in which sensitizing dyes are dissolved in an acid and the solution is added to an emulsion, or sensitizing dyes are added to an emulsion as an aqueous solution coexisting with an acid or a base as disclosed in JP-B-44-23389, JP-B-44-27555 and JP-B-57-22091, a method in which dyes are added to an emulsion as an aqueous solution or colloidal dispersion coexisting with a surfactant as disclosed in U.S. Pat. Nos. 3,822,135 and 4,006,025, a method in which dyes are directly dispersed in a hydrophilic colloid and the dispersion is added to an emulsion as disclosed in JP-A-53-102733 and JP-A-58-105141, or a method in which dyes are dissolved and the solution is added to an emulsion as disclosed in JP-A-51-74624 can be used. Further, ultrasonic waves can be used for dissolution.

The time of the addition of the sensitizing dyes for use in the present invention to the silver halide emulsion of the present invention may be at any stage of the preparation of the emulsion recognized as useful hitherto. They may be added at any time or in any stage if it is before coating of the emulsion, for example, before grain formation stage of silver halide grains or/and desalting stage, during desilvering stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating of the emulsion as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during chemical ripening stage and the remaining after completion of chemical ripening. The kinds of compounds added separately and combinations of compounds may be varied.

The addition amount of the sensitizing dyes for use in the present invention is varied in accordance with the shape, size and halogen composition of silver halide grains, the method and degree of chemical sensitization, and the kind of antifoggant, but they can be used in an amount of from $4\times10^{-6}$ to $8\times10^{-3}$ mol per mol of the silver halide. For example, when the grain size of the silver halide grains is from 0.2 to 1.3 $\mu$m, the addition amount is preferably from $2\times10^{-7}$ to $3.5\times10^{-6}$ mol and more preferably from $6.5\times10^{-7}$ to $2.0\times10^{-6}$ mol, per $m^2$ of the surface area of the silver halide grains.

The silver halide in the silver halide emulsion for use in the silver halide photographic material according to the present invention is not particularly limited and any of silver chloride, silver chlorobromide, silver bromide, silver iodochlorobromide or silver iodobromide can be used but is preferably silver chlorobromide or silver iodochlorobromide having a silver chloride content of 50 mol % or more. The form of the silver halide grain may be any of a cubic, tetradecahedral, octahedral, amorphous or plate-like form, but a cubic form is preferred. The average grain size of silver halide grains is preferably from 0.1 $\mu$m to 0.7 $\mu$m, and more preferably from 0.1 $\mu$m to 0.5 $\mu$m. With respect to the grain size distribution, grains having a narrow grain size distribution such that the variation coefficient represented by [(standard deviation of the grain sizes)/(average grain size)]×100 is preferably 15% or less, more preferably 10% or less, are preferred.

The interior and the surface layer of the silver halide grains may comprise a uniform phase or may be different. A localized layer having different halogen composition may be present inside or on the surface of the silver halide grains.

The photographic emulsion for use in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

That is, any process, such as an acid process and a neutral process, can be used. A single jet method, a double jet method, and a combination of them are known as methods for reacting a soluble silver salt with a soluble halide, and any of these methods can be used.

A method in which grains are formed in the presence of excess silver ion (a so-called reverse mixing method) can also be used. A method in which the pAg in the liquid phase in which the silver halide is formed is kept constant, that is, the controlled double jet method, can also be used as one type of the double jet method. Moreover, the grain formation is preferably carried out using silver halide solvents such as ammonia, thioether, or tetra-substituted thiourea. More preferred are tetra-substituted thiourea compounds and they are disclosed in JP-A-53-82408 and JP-A-55-77737. Preferred thiourea compounds are tetramethylthiourea and 1,3-dimethyl-2-imidazolidinethione. As the addition amount of a silver halide solvent varies depending on the kind of the compound to be used, the objective grain size, and the halogen composition, from $10^{-5}$ to $10^{-2}$ mol per mol of the silver halide is preferred.

Silver halide emulsions with a regular crystal form and a narrow grain size distribution can easily be obtained by the controlled double jet method and the grain formation method using silver halide solvents, which are effective to prepare the silver halide emulsion for use in the present invention.

Moreover, the method in which the addition rates of silver nitrate and alkali halide are varied according to the grain growth rate as disclosed in British Patent 1,535,016, JP-B-48-36890 and JP-B-52-16364, and the method in which the concentrations of aqueous solutions are varied as disclosed in British Patent 4,242,445 and JP-A-55-158124 are preferably and effectively used to rapidly grow grains within the range not exceeding the critical degree of saturation in order to provide uniform grain size.

It is preferred that at least one kind of a metal selected from the group consisting of rhodium, rhenium, ruthenium, osmium and iridium is contained in silver halide grains for use in the silver halide photographic material of the present invention to attain high contrast and low fog generation. The content thereof is preferably from $1\times10^{-9}$ mol to $1\times10^{-5}$ mol, more preferably from $1\times10^{-8}$ mol to $5\times10^{-6}$ mol, per mol of the silver. These metals can be used in combination of two or more. These metals can be included in silver halide grains uniformly or may be distributed locally in grain as disclosed in JP-A-63-29603, JP-A-2-306236, JP-A-3-167545, JP-A-4-76534, JP-A-6-110146 and Japanese Patent Application No. 4-68305.

Water-soluble rhodium compounds can be used as a rhodium compound in the present invention, for example, rhodium(III) halide compounds, or rhodium complex salts having halogen, amines, or oxalato as a ligand, such as hexachlororhodium(III) complex salts, pentachloroaquorhodium(III) complex salts, tetrachlorodiaquorhodium(III) complex salts, hexabromorhodium(III) complex salts, hexaamminerhodium(III) complex salts, trioxalatorhodium (III) complex salts and the like. These rhodium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of rhodium compound can be used. It is also possible to include and dissolve other silver halide grains which have been previously doped with rhodium during the preparation of silver halide instead of using water-soluble rhodium.

The addition amount of these rhodium compounds is preferably from $1\times10^{-8}$ mol to $5\times10^{-6}$ mol, and particularly preferably from $5\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Rhenium, ruthenium and osmium for use in the present invention are added in the form of water-soluble complex salts as disclosed in JP-A-63-2042, JP-A-1-285941, JP-A-2-20852 and JP-A-2-20855. Particularly preferred compounds are complexes having six ligands represented by the following formula:

$$[ML_6]^{n-}$$

wherein M represents Ru, Re or Os, and n represents 0, 1, 2, 3 or 4.

In this case, counter ions are not important and ammonium or alkali metal ions are used.

Examples of preferred ligands include a halide ligand, a cyanide ligand, a cyanogen oxide ligand, a nitrosyl ligand, and a thionitrosyl ligand. Specific examples of complexes for use in the present invention are shown below but the present invention is not limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compounds is preferably from $1\times10^{-9}$ mol to $1\times10^{-5}$ mol, and particularly preferably from $1\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Various methods can be used for the addition of these compounds during grain formation of silver halide and incorporating them into silver halide grains, for example, a method in which a metal complex powder per se or an aqueous solution dissolved therein a metal complex powder with NaCl and KCl is previously added to a solution of water-soluble salt or water-soluble halide for grain formation, a method in which a metal complex powder is simultaneously added as the third solution when a solution of silver salt and a solution of halide are mixed to prepare silver halide grains by a triple jet method by three solutions, or a method in which a necessary amount of an aqueous solution of a metal complex powder is added to a reaction vessel during grain formation. A method in which a metal complex powder per se or an aqueous solution dissolved therein a metal complex powder with NaCl and KCl is added to a water-soluble halide solution is particularly preferred.

When these compounds are added to surfaces of grains, a necessary amount of an aqueous solution of metal complexes can be added to a reaction vessel immediately after grain formation, during or at the time of finishing of physical ripening, or during chemical ripening.

Various iridium compounds can be used in the present invention, for example, hexachloroiridium, hexaammineiridium, trioxalatoiridium, hexacyanoiridium, pentachloronitrosyliridium and the like. These iridium compounds are used being dissolved in water or an appropriate solvent. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of iridium compound can be used. It is also possible to include and dissolve other silver halide grains which have been previously doped with iridium during the preparation of silver halide instead of using water-soluble iridium.

The silver halide grains according to the present invention may be doped with other heavy metal salts. In particular, doping with hexacyanide metal complexes, such as $K_4[Fe(CN)_6]$, $K_4[Ru(CN)_6]$ and $K_3[Cr(CN)_6]$ is advantageous.

Further, the silver halide grains for use in the present invention may contain metal atoms such as cobalt, nickel, palladium, platinum, gold, thallium, copper, or lead. The preferred addition amount of these metals is from $1\times10^{-9}$ to $1\times10^{-4}$ mol per mol of the silver halide. These metals can be added as a metal salt in the form of a single salt, a double salt or a complex salt during the preparation of grains.

The silver halide emulsion of the present invention is preferably chemically sensitized. Conventionally known chemical sensitization methods such as sulfur sensitization, selenium sensitization, tellurium sensitization and noble metal sensitization can be used alone or in combination. When sensitization is conducted in combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization are preferred, for example.

The sulfur sensitization for use in the present invention is usually carried out by adding a sulfur sensitizer and stirring the emulsion at high temperature of 40° C. or more for a certain period of time. Various known sulfur compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfates and thioureas. The addition amount of a sulfur sensitizer is varied in accordance with various conditions such as the pH and temperature during chemical ripening and the grain size of the silver halide grains, but is preferably from $10^{-7}$ to $10^{-2}$ mol and more preferably from $10^{-5}$ to $10^{-3}$ mol, per mol of the silver halide.

Various known selenium compounds can be used as a selenium sensitizer in the present invention. The selenium sensitization is usually carried out by adding unstable and/or non-unstable selenium compounds and stirring the emulsion at high temperature, preferably 40° C. or more, for a certain period of time. The compounds disclosed in JP-B-44-15748, JP-B-43-13489, JP-A-4-25832, JP-A-4-109240 and JP-A-4-324855 can be used as unstable selenium compounds. The compounds represented by formulae (VIII) and (IX) disclosed in JP-A-4-324855 are particularly preferably used.

The tellurium sensitizer for use in the present invention is a compound which forms silver telluride in the surfaces or interiors of silver halide grains, which silver telluride is presumed to become sensitization speck. The formation rate of the silver telluride in the silver halide emulsion can be examined according to the method disclosed in JP-A-5-313284.

Specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai compiled, *The Chemistry of Organic Selenium and Tellurium Compounds,* Vol. 1 (1986), and ibid., Vol. 2 (1987). The compounds represented by formulae (II), (III) and (IV) disclosed in JP-A-5-313284 are particularly preferred.

The amount of the selenium and tellurium sensitizers to be used in the present invention varies according to the silver halide grains used and the conditions of chemical ripening, but is generally about $10^{-8}$ to $10^{-2}$ mol, preferably about $10^{-7}$ to $10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

The noble metal sensitizers which are used in the present invention include gold, platinum, palladium and iridium, and gold sensitization is particularly preferred. Specific examples of the gold sensitizers for use in the present invention include chloroauric acid, potassium chloroaurate, potassium aurithiocyanate and gold sulfide, and the amount of about $10^{-7}$ to $10^{-2}$ mol per mol of the silver halide can be used.

Cadmium salt, sulfite, lead salt and thallium salt may be coexist in the silver halide emulsion for use in the present invention in the process of the formation or physical ripening of silver halide grains.

Reduction sensitization can be used in the present invention. As reduction sensitizers there may be used stannous salt, amines, formamidinesulfinic acid, and silane compounds.

Thiosulfonic acid compounds may be added to the silver halide emulsion of the present invention according to the method disclosed in European Patent 293917.

The silver halide emulsion in the photographic material of the present invention may be one kind, or two or more kinds of silver halide emulsions (for example, those differing in average grain sizes, differing in halogen compositions, differing in crystal habits, or differing in the conditions of chemical sensitization) may be used in combination.

The photographic material for use in the present invention preferably contains at least one kind of a hydrazine compound in order to obtain a superhigh contrast image. The hydrazine compounds (derivatives) for use in the present invention are described below.

The compounds represented by formula (I) disclosed in JP-A-7-287355 can be used in the present invention, specifically Compounds I-1 to I-53.

The following hydrazine derivatives are also preferably used:

The compound represented by (chem. 1) disclosed in JP-B-6-77138, specifically the compounds on pages 3 and 4 of the same patent; the compound represented by formula (I) disclosed in JP-B-6-93082, specifically Compounds 1 to 38 on pages 8 to 18 of the same patent; compounds represented by formulae (4), (5) and (6) disclosed in JP-A-6-230497, specifically Compounds 4-1 to 4-10 on pages 25 and 26, Compounds 5-1 to 5-42 on pages 28 to 36, and Compounds 6-1 to 6-7 on pages 39 and 40 of the same patent; compounds represented by formulae (1) and (2) disclosed in JP-A-6-289520, specifically Compounds 1-1) to 1-17) and 2-1) on pages 5 to 7 of the same patent; compounds represented by (chem. 2) and (chem. 3) disclosed in JP-A-6-313936, specifically the compounds on pages 6 to 19 of the same patent; the compound represented by (chem. 1) disclosed in JP-A-6-313951, specifically the compounds on pages 3 to 5 of the same patent; the compound represented by formula (I) disclosed in JP-A-7-5610, specifically Compounds I-1 to I-38 on pages 5 to 10 of the same patent; the compound represented by formula (II) disclosed in JP-A-7-77783, specifically Compounds II-1 to II-102 on pages 10 to 27 of the same patent; compounds represented by formula (H) and (Ha) disclosed in JP-A-7-104426, specifically Compounds H-1 to H-44 on pages 8 to 15 of the same patent; compounds having an anionic group or a nonionic group which forms an intramolecular hydrogen bond with the hydrogen atom of the hydrazine in the vicinity of the hydrazine group represented by formulae (A), (B), (C), (D), (E) and (F) disclosed in JP-A-9-22082, specifically Compounds N-1 to N-30 disclosed in the same patent; and the compound represented by formula (1) disclosed in JP-A-9-22082, specifically Compounds D-1 to D-55 disclosed in the same patent.

Examples of hydrazine derivatives preferably used in the present invention are shown below, but the present invention is not limited thereto.

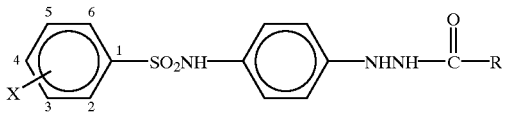
| | X = | R = —H | —$C_2F_4$—COOH (n-$C_2F_4$—$COO^{\ominus}K^+$) | 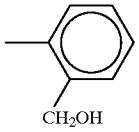 | 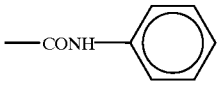 |
|---|---|---|---|---|---|
| 1 | 3-$NHCOC_9H_{19}$ | 1a | 1b | 1c | 1d |
| 2 | 3-NHCONH—S—$C_7H_{15}$(n) | 2a | 2b | 2c | 2d |
| 3 | 3-$NHCOCH_2$—$\overset{\oplus}{N}$ | 3a | 3b | 3c | 3d |
| 4 | 3-$NHCOCH_2$—$\overset{\oplus}{N}$($CH_3$)($CH_3$)—$C_8H_{17}$ $Cl^{\ominus}$ | 4a | 4b | 4c | 4d |
| 5 | 3-NHCO— | 5a | 5b | 5c | 5d |
| 6 | 3-NHCONH— | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |
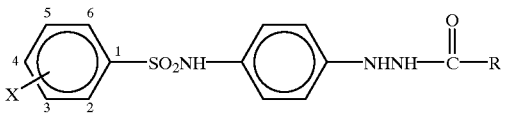
| | X = | R = —H | —$CF_2H$ | —$CH_2$—$\overset{\oplus}{N}$ $Cl^{\ominus}$ | —CONH—  |
|---|---|---|---|---|---|
| 8 | 3-$CONHCH_2CH$($C_2H_5$)—$C_4H_9$ | 8a | 8e | 8f | 8g |

-continued
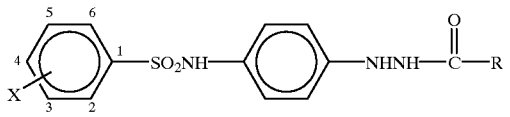
| | X = | R = —H | —$CF_2H$ | —$CH_2$—$N^{\oplus}$(Cl$^{\ominus}$) | —CONH— (NH) |
|---|---|---|---|---|---|
| 9 | 6-$OCH_3$-3-$C_5H_{11}$(t) | 9a | 9e | 9f | 9g |
| 10 | 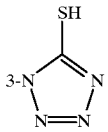 | 10a | 10e | 10f | 10g |
| 11 | 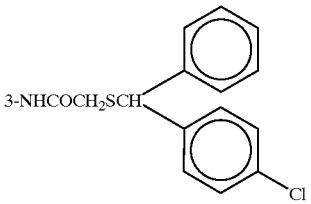 | 11a | 11e | 11f | 11g |
| 12 | 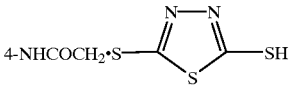 | 12a | 12e | 12f | 12g |
| 13 | 3-NHCOCH—$C_8H_{17}$ / $CH_2COOH$ | 13a | 13e | 13f | 13g |
| 14 | $C_2H_5$ / 3,5-(CONH$CH_2$CH—$C_4H_9$)$_2$ | 14a | 14e | 14f | 14g |
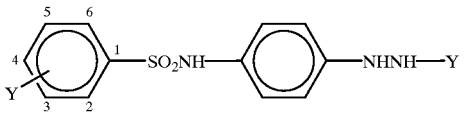
| Y = | X = —CHO | —$COCF_3$ | —$SO_2CH_3$ | —P(O)$(OC_2H_5)_2$ |
|---|---|---|---|---|
| 15 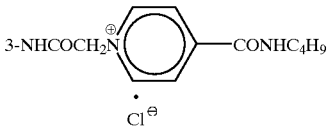 | 15a | 15h | 15i | 15j |

-continued
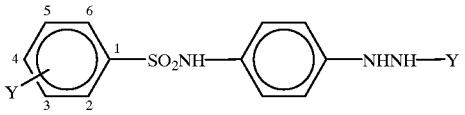
| | Y = | X = —CHO | —$COCF_3$ | —$SO_2CH_3$ | —$P(=O)(OC_2H_5)_2$ |
|---|---|---|---|---|---|
| 16 | 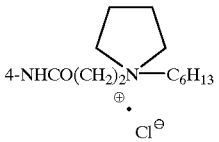 | 16a | 16h | 16i | 16j |
| 17 | 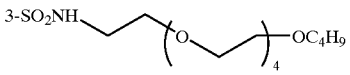 | 17a | 17h | 17i | 17j |
| 18 | 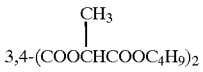 | 18a | 18h | 18i | 18j |
| 19 | 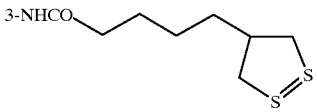 | 19a | 19h | 19i | 19j |
| 20 | 3-$NHSO_2NH$—$C_8H_{17}$ | 20a | 20h | 20i | 20j |
| 21 | 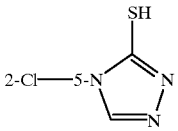 | 21a | 21h | 21i | 21j |
| | | R = —H | —$CF_2H$ | —$CF_2$ | —$CONHC_3H_7$ |
|---|---|---|---|---|---|
| 22 | 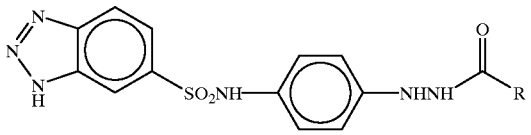 | 22a | 22e | 22k | 22l |
| 23 | 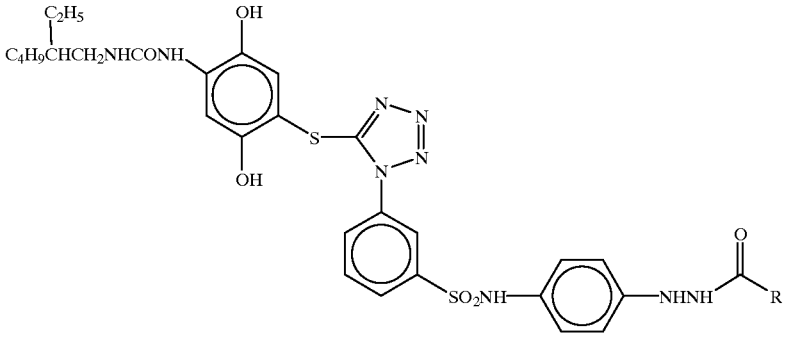 | 23a | 23e | 23k | 23l |

-continued
| | | R = | | | |
|---|---|---|---|---|---|
| | | —H | —$CF_2H$ | —$CF_2$ | —$CONHC_3H_7$ |
| 24 | 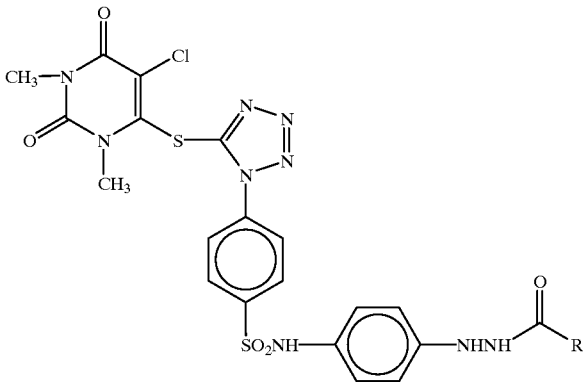 | 24a | 24e | 24k | 24l |
| 25 | 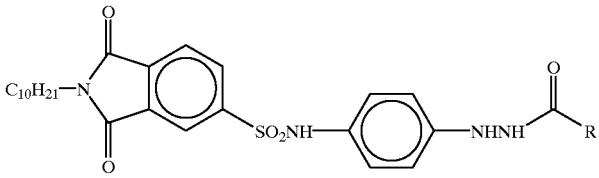 | 25a | 25e | 25k | 24l |
| 26 | 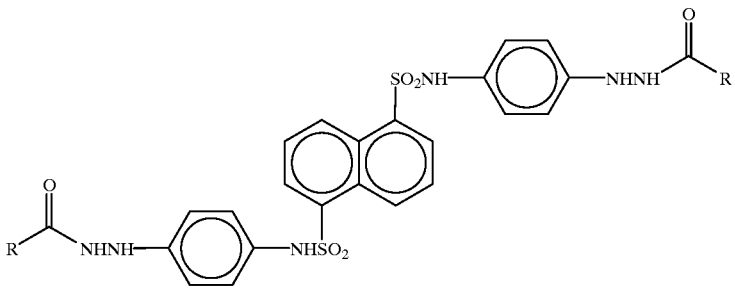 | 26a | 26e | 26k | 26l |
| 27 | 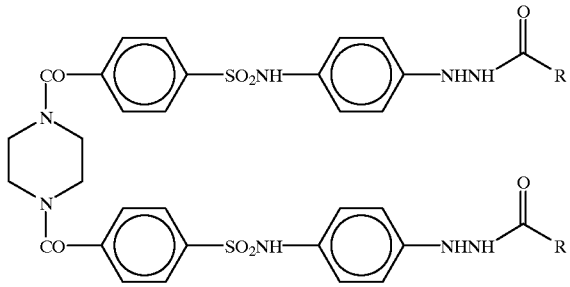 | 27a | 27e | 27k | 27l |
| 28 | 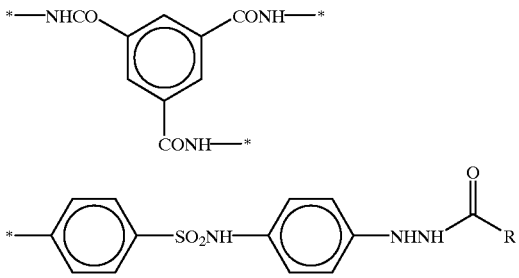 | 28a | 28e | 28k | 28l |

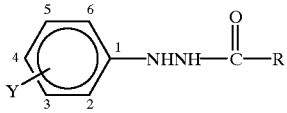
| | Y = | R = —H | —$CH_2OCH_3$ | 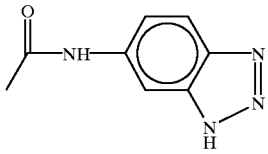 | 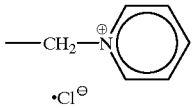 |
|---|---|---|---|---|---|
| 29 | 4-NHC(=S)NH—$C_8H_{17}$(n) | 29a | 29m | 29n | 29f |
| 30 | 4-NHP(—$OCH_2$—$C_6H_5$)$_2$ | 30a | 30m | 30n | 30f |
| 31 | 4-NHCONH—$(CH_2)_3O$—$C_6H_4$—C(CH$_3$)$_2$—CH$_2$CH$_3$ | 31a | 31m | 31n | 31f |
| 32 | 4-OH<br>3-NHCONH$CH_2$CH($C_2H_5$)—$C_4H_9$ | 32a | 32m | 32n | 32f |
| 33 | 4-$NHSO_2(CH_2)_2NHCO$—$C_6H_4$— 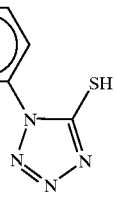 | 33a | 33m | 33n | 33f |
| 34 | 4-$OCH_2$—$C_6H_5$ | 34a | 34m | 34n | 34f |
| 35 | 4-NHCONH—N($CH_2$—$C_6H_5$)$_2$ | 35a | 35m | 35n | 35f |

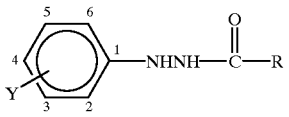
| | Y = | R = —H | —$C_3F_6$—COOH | —$CONHCH_3$ | 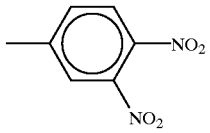 |
|---|---|---|---|---|---|
| 36 | 2-$NHSO_2CH_3$— <br> 4-$NHCONH(CH_2)_3S$— 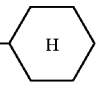 | 36a | 36o | 36p | 36q |
| 37 | 2-$OCH_3$— <br> 4-$NHSO_2C_{12}H_{25}$ | 37a | 37o | 37p | 37q |
| 38 | 3-$NHCOC_{11}H_{23}$— <br> 4-$NHSO_2CF_3$ | 38a | 38o | 38p | 38q |
| 39 | 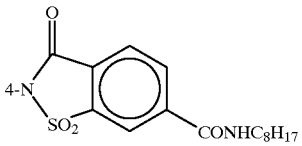 | 39a | 39o | 39p | 39q |
| 40 | 4-$OCO(CH_2)_2COOC_6H_{13}$ | 40a | 40o | 40p | 40q |
| 41 | 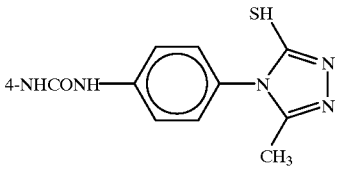 | 41a | 41o | 41p | 41q |
| 42 | 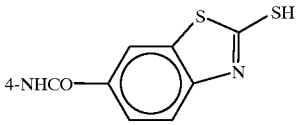 | 42a | 42o | 42p | 42q |
43
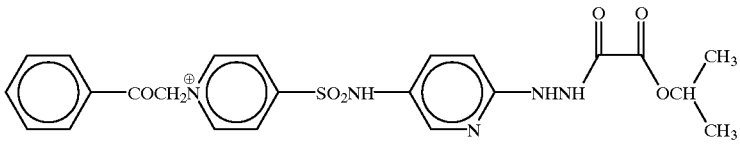
44
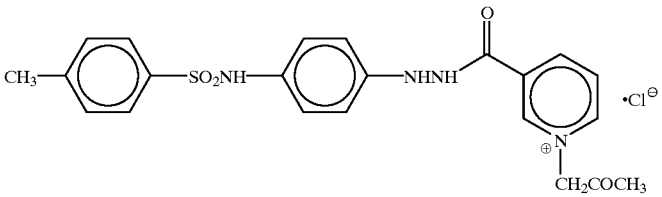

-continued
45
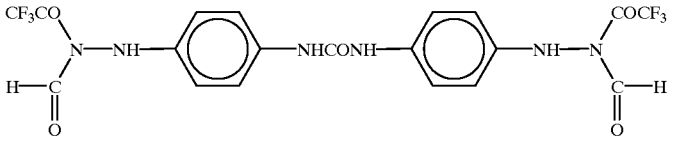
46
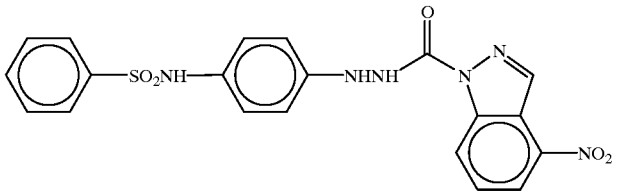
47
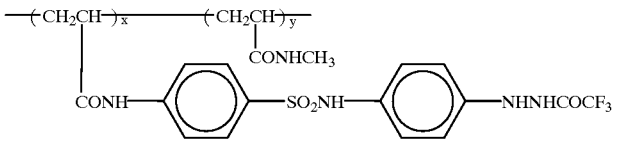
x/y = 3/97
av. mol. wt.:
about 100,000
48
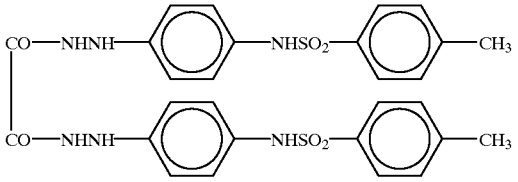
49
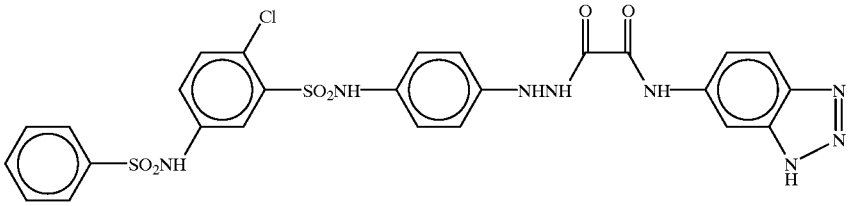
50
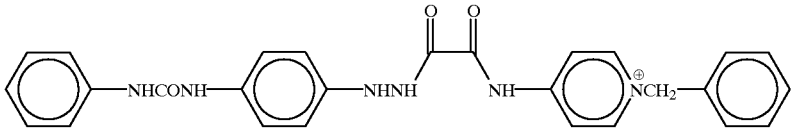

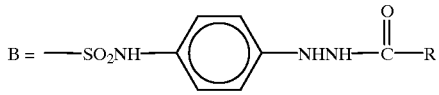
| | | R = —H | —CF2H | —CONHCH3 | —CF3 |
|---|---|---|---|---|---|
| 51 | 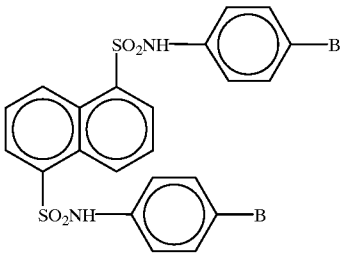 | 51a | 51e | 51p | 51r |
| 52 | 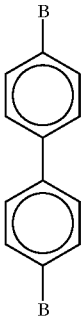 | 52a | 52e | 52p | 52r |
| 53 | 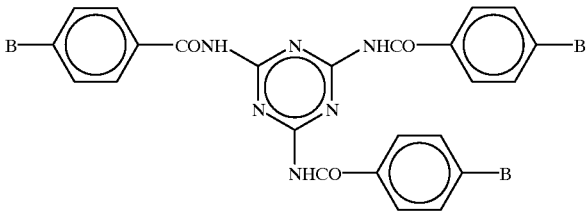 | 53a | 53e | 53p | 53r |
| 54 | 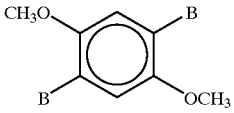 | 54a | 54e | 54p | 54r |
| 55 | 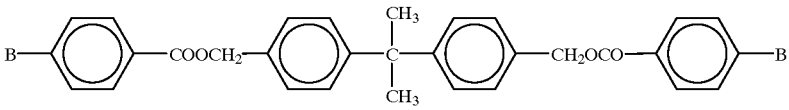 | 55a | 55e | 55p | 55r |
| 56 | 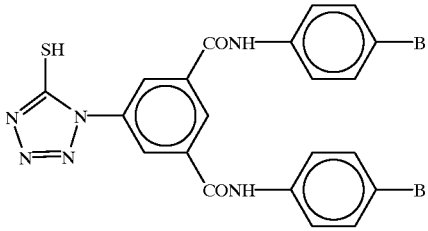 | 56a | 56e | 56p | 56r |

-continued
B = 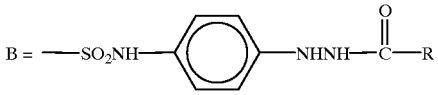
| | | R = | | | |
|---|---|---|---|---|---|
| | | —H | —$CF_2H$ | —$CONHCH_3$ | —$CF_3$ |
| 57 | 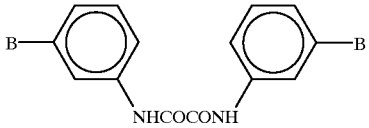 | 57a | 57e | 57p | 57r |
| | | R = | | | |
|---|---|---|---|---|---|
| | | —H | —$CF_3$ | 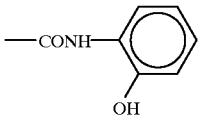 | 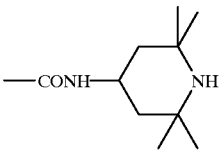 |
| 58 | 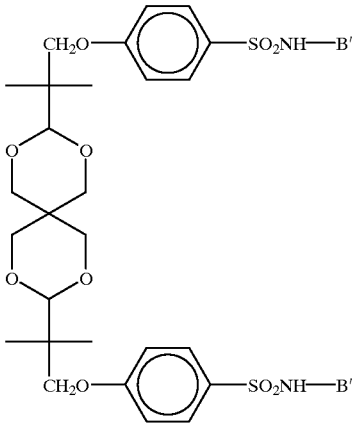 | 58a | 58e | 58s | 58g |
| 59 | 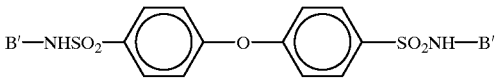 | 59a | 59e | 59s | 59g |
| 60 | 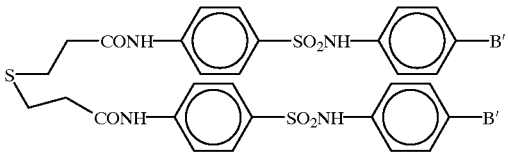 | 60a | 60e | 60s | 60g |
| 61 | 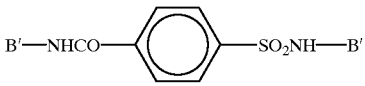 | 61a | 61e | 61s | 61g |

-continued
| | | R = | | | |
|---|---|---|---|---|---|
| | | —H | —$CF_3$ | —CONH— OH | —CONH— NH |
| 62 | 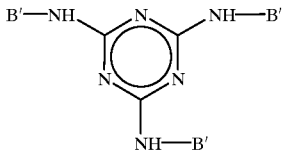 | 62a | 62e | 62s | 62g |
| 63 | 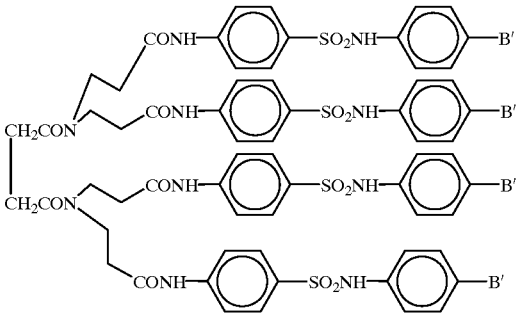 | 63a | 63e | 63s | 63g |
| 64 | 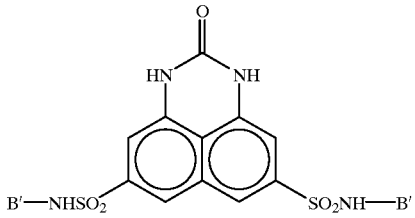 | 64a | 64e | 64s | 64g |
65
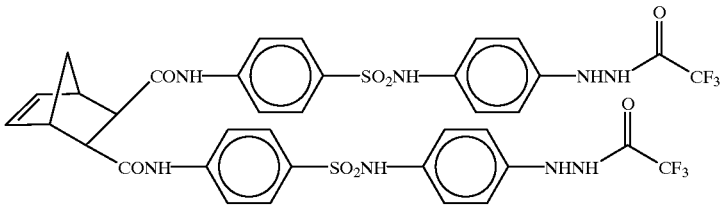
66
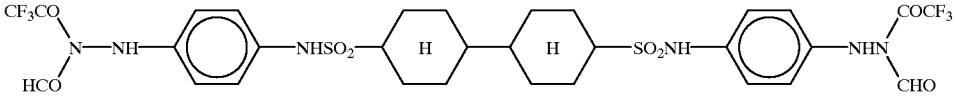
67
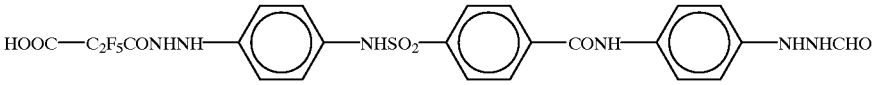

-continued

68

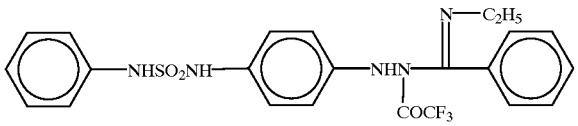

69

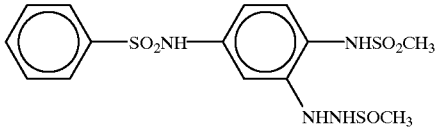

70

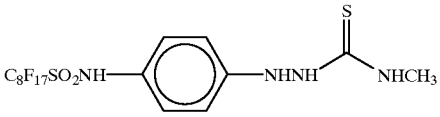

71

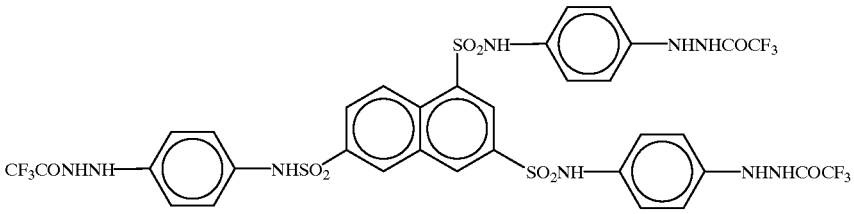

72

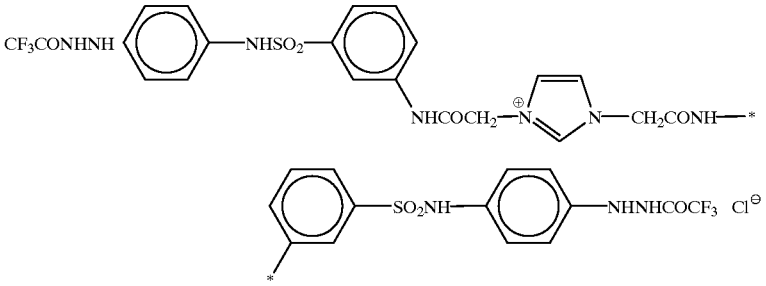

The hydrazine nucleating agents of the present invention can be used being dissolved in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the hydrazine nucleating agents for use in the present invention can be used in the form of an emulsion dispersion mechanically prepared according to well known emulsifying dispersion methods by dissolving using oils such as dibutyl phthalate, tricresyl phosphate, glyceryl triacetate or diethyl phthalate, or auxiliary solvents such as ethyl acetate and cyclohexanone, or they can be used in the form of a dispersion prepared according to a solid dispersion method in which powders of hydrazine derivatives are dispersed in water using a ball mill, a colloid mill or ultrasonic wave.

The hydrazine nucleating agents of the present invention can be added to a silver halide emulsion layer or any other hydrophilic colloid layers on the silver halide emulsion layer side of the support, but are preferably added to the silver halide emulsion layer or the hydrophilic colloid layer adjacent thereto.

The amount of the nucleating agents for use in the present invention is preferably from $1\times10^{-6}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of the silver halide.

Amine derivatives, onium salts, disulfide derivatives or hydroxymethyl derivatives can be used as a nucleation accelerating agent in the present invention. Examples of nucleation accelerating agents are enumerated below: the compounds disclosed in lines 2 to 37, page 48 of JP-A-7-77783, specifically Compounds A-1) to A-73), pages 49 to 58 of the same patent; compounds represented by (chem. 21), (chem. 22) and (chem. 23) disclosed in JP-A-7-84331, specifically the compounds on pages 6 to 8 of the same patent; compounds represented by formulae (Na) and (Nb) disclosed in JP-A-7-104426, specifically Compounds Na-1 to Na-22 and Nb-1 to Nb-12 on pages 16 to 20 of the same patent; and compounds represented by formulae (1) to (7) disclosed in JP-A-8-272023, specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58, and Compounds 7-1 to 7-38 disclosed in the same patent.

Specific examples of nucleation accelerating agents are shown below.

A-1)

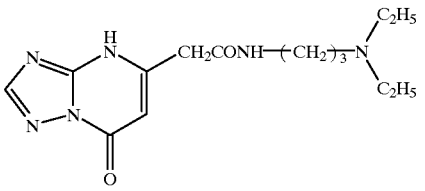

A-2)

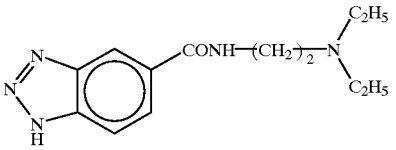

A-3)

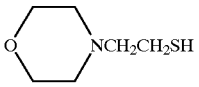

A-4)

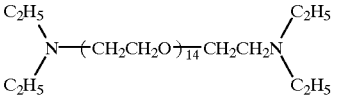

A-5)

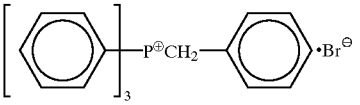

A-6)

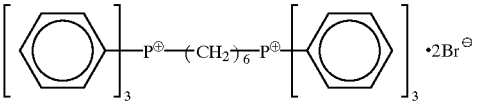

A-7)

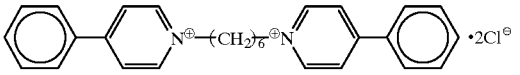

A-8)

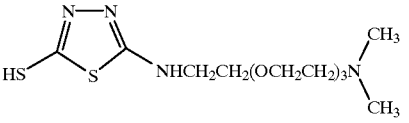

A-9)

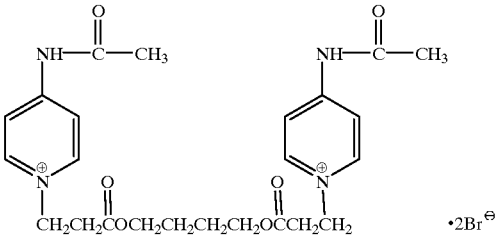

A-10)

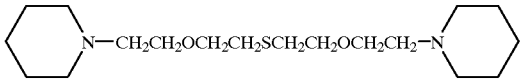

Nucleation accelerating agents for use in the present invention can be used being dissolved in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the nucleation accelerating agents for use in the present invention can be used in the form of an emulsion dispersion mechanically prepared according to well known emulsifying dispersion methods by dissolving using oils such as dibutyl phthalate, tricresyl phosphate, glyceryl triacetate or diethyl phthalate, or auxiliary solvents such as ethyl acetate and cyclohexanone, or they can be used in the form of a dispersion prepared according to a solid dispersion method in which powders of nucleation accelerating agents are dispersed in water using a ball mill, a colloid mill or ultrasonic wave.

The nucleation accelerating agents of the present invention can be added to a silver halide emulsion layer or any other hydrophilic colloid layers on the silver halide emulsion layer side of the support, but are preferably added to the silver halide emulsion layer or the hydrophilic colloid layer adjacent thereto.

The amount of the nucleating agents for use in the present invention is preferably from $1\times10^{-6}$ to $2\times10^{-2}$ mol, more preferably from $1\times10^{-5}$ to $2\times10^{-2}$ mol, and most preferably from $2\times10^{-5}$ to $1\times10^{-2}$ mol, per mol of the silver halide.

There is no particular limitation on various additives for use in the present invention and, for example, those described in the following places can preferably be used.

Polyhydroxybenzene Compound

Line 11, right lower column, page 10 to line 5, left lower column, page 12 of JP-A-3-39948, specifically Compounds (C)-1 to (C)-25 disclosed in the same patent.

Compound Which Substantially Does not Have Absorption Maximum in Visible Region

The compound represented by formula (a) disclosed in JP-A-1-118832, specifically Compounds (a)-1 to (a)-26 in the same patent.

Antifoggant

Line 19, right lower column, page 17 to line 4, right upper column, page 18 of JP-A-2-103536.

Polymer Latex

Line 12, left lower column, page 18 to line 20, left lower column, the same page of JP-A-2-103536; the polymer latex having an active methylene group represented by formula (a) disclosed in JP-A-9-179228, specifically Compounds (a)-1 to (a)-16 disclosed in the same patent; and the polymer latex having a core/shell structure disclosed in JP-A-9-179228, specifically Compounds P-1 to P-55 disclosed in the same patent.

Matting Agent, Sliding Agent and Plasticizer

Line 15, left upper column, page 19 to line 15, right upper column, the same page of JP-A-2-103536.

Hardening Agent

Line 5, right upper column, page 18 to line 17, right upper column, the same page of JP-A-2-103536.

Compound Having Acid Radical

Line 6, right lower column, page 18 to the first line, left upper column, page 19 of JP-A-2-103536.

Conductive Material

Line 13, left lower column, page 2 to line 7, right upper column, page 3 of JP-A-2-18542, specifically metal oxides disclosed in line 2, right lower column, page 2 to line 10, right lower column of the same page, and conductive high polymer Compounds P-1 to P-7 disclosed in the same patent.

Water-Soluble Dye

The first line, right lower column, page 17 to line 18, right upper column of the same page of JP-A-2-103536.

Solid Dispersion Dye

Compounds represented by formulae (FA), (FA1), (FA2) and (FA3) disclosed in JP-A-9-179243, specifically Compounds F1 to F-34 in the same patent; Compounds (II-2) to (II-24) disclosed in JP-A-7-152112; Compounds (III-5) to (III-18) disclosed in JP-A-7-152112; Compounds (IV-2) to (IV-7) disclosed in JP-A-7-152112; and compounds disclosed in JP-A-2-294638 and JP-A-5-11382.

Surfactant

Surfactants disclosed in line 7, right upper column, page 9 to line 3, right lower column of the same page of JP-A-2-12236; polyethylene glycol surfactants disclosed in line 4, left lower column, page 18 to line 7, left lower column of the same page of JP-A-2-103536; and fluorine surfactants disclosed in line 6, left lower column, page 12 to line 5, right lower column, page 13 of JP-A-3-39948, specifically Compounds (f)-1 to (f)-15 of the same patent.

Nucleation Accelerating Agent, Such as Amine Derivatives, Onium Salts, Disulfide Derivatives or Hydroxymethyl Derivatives Compounds disclosed in lines 2 to 37, page 48 of JP-A-7-77783, specifically Compounds A-1) to A-73), pages 49 to 58 of the same patent; compounds represented by (chem. 21), (chem. 22) and (chem. 23) disclosed in JP-A-7-84331, specifically the compounds on pages 6 to 8 of the same patent; compounds represented by formulae (Na) and (Nb) disclosed in JP-A-7-104426, specifically Compounds Na-1 to Na-22 and Nb-1 to Nb-12 on pages 16 to 20 of the same patent; and compounds represented by formulae (1) to (7) disclosed in JP-A-8-272023, specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58, and Compounds 7-1 to 7-38 of the same patent.

Redox Compound

Redox compounds capable of releasing a development inhibitor by oxidation disclosed in JP-A-5-274816, preferably the redox compound represented by any of formulae (R-1), (R-2) and (R-3), specifically Compounds R-1 to R-68 in the same patent.

Binder

From the first line to line 20, right lower column, page 3 of JP-A-2-18542.

As the support which can be used in the present invention, for example, baryta paper, polyethylene-laminated paper, polypropylene synthetic paper, glass sheet, cellulose acetate, cellulose nitrate, and polyester films, e.g., polyethylene terephthalate can be cited. These supports are respectively arbitrarily selected according to the use purpose of the silver halide photographic material.

The swelling factor of the hydrophilic colloid layers including emulsion layers and protective layers of the silver halide photographic material according to the present invention is preferably from 80 to 150%, more preferably from 90 to 140%. The swelling factor of the hydrophilic colloid layers is obtained according to the following equation by measuring the thickness of the hydrophilic colloid layers ($d_0$) including emulsion layers and protective layers of the silver halide photographic material, immersing the silver halide photographic material in distilled water of 25° C. for 1 minute and determining the swollen thickness ($\Delta d$).

$$\text{Swelling factor } (\%) = \Delta d \div d_0 \times 100$$

Processing agents such as a developing solution and a fixing solution and processing methods in the present invention are described below. A developing agent for use in a developing solution (hereinafter, a developing starter and a developing replenisher are referred to as a developing solution put together) according to the present invention is not particularly limited, but it is preferred to contain dihydroxybenzenes, ascorbic acid derivatives and hydroquinonemonosulfonate, alone or in combination. Further, from the point of developing capability, combination of dihydroxybenzenes or ascorbic acid derivatives with 1-phenyl-3-pyrazolidones, or combination of dihydroxybenzenes or ascorbic acid derivatives with p-aminophenols is preferred.

Dihydroxybenzene developing agents include hydroquinone, chlorohydroquinone, isopropylhydroquinone, and methylhydroquinone, and hydroquinone is particularly preferred. Ascorbic acid derivative developing agents include ascorbic acid, isoascorbic acid, and salts thereof, and sodium erythorbate is particularly preferred from the economical point of the material.

1-Phenyl-3-pyrazolidones or derivatives thereof as a developing agent include 1-phenyl-3-pyrazolidone, 1-phenyl-4,4-dimethyl-3-pyrazolidone, and 1-phenyl-4-methyl-4-hydroxymethyl-3-pyrazolidone.

p-Aminophenol developing agents include N-methyl-p-aminophenol, p-aminophenol, N-(B-hydroxyphenyl)-p-aminophenol, and N-(4-hydroxyphenyl)glycine, and N-methyl-p-aminophenol is preferred.

Dihydroxybenzene developing agents are, in general, preferably used in an amount of from 0.05 to 0.8 mol/liter. When dihydroxybenzenes are used in combination with 1-phenyl-3-pyrazolidones or p-aminophenols, the amount used of the former is preferably from 0.05 to 0.6 mol/liter, more preferably from 0.23 to 0.5 mol/liter, and the latter is 0.06 mol/liter or less, preferably from 0.03 to 0.003 mol/liter.

Ascorbic acid derivative developing agents are, in general, preferably used in an amount of from 0.01 to 0.5 mol/liter, more preferably from 0.05 to 0.3 mol/liter. Further, when ascorbic acid derivatives are used in combination with 1-phenyl-3-pyrazolidones or p-aminophenols, the amount used of ascorbic acid derivatives is preferably from 0.01 to 0.5 mol/liter, and that of 1-phenyl-3-pyrazolidones or p-aminophenols is preferably from 0.005 mol/liter to 0.2 mol/liter.

A developing solution for processing a photographic material in the present invention can contain additives generally used (e.g., a developing agent, an alkali agent, a pH buffer, a preservative, a chelating agent, etc.). Specific examples of them are shown below but the present invention is not limited to these.

A buffer which is used in a developing solution for development processing a photographic material in the present invention includes carbonate, boric acids disclosed in JP-A-62-186259, saccharides (e.g., saccharose) disclosed in JP-A-60-93433, oximes (e.g., acetoxime), phenols (e.g., 5-sulfosalicylic acid) or tertiary phosphate (e.g., sodium salt, potassium salt), preferably carbonate and boric acid. The use amount of a buffer, in particular carbonate, is preferably 0.01 mol/liter or more, particularly preferably from 0.05 to 1.5 mol/liter.

Examples of the preservatives for use in the present invention include sodium sulfite, potassium sulfite, lithium sulfite, ammonium sulfite, sodium bisulfite, potassium metabisulfite, and sodium formaldehyde bisulfite. Preferred addition amount of the sulfite preservative is 0.2 mol/liter or more, particularly preferably 0.3 mol/liter or more, but as too much an amount causes silver contamination of the developing solution, the upper limit is preferably 1.2 mol/liter, particularly preferably from 0.35 to 0.7 mol/liter.

A small amount of ascorbic acid derivatives may be used in combination with sulfite as a preservative for dihydroxybenzene developing agents. The use of sodium erythorbate is economically preferred. The addition amount thereof is preferably from 0.03 to 0.12, particularly preferably from 0.05 to 0.10, in molar ratio to dihydroxybenzene developing agent. When ascorbic acid derivatives are used as a preservative, it is preferred not to contain boron compounds in the developing solution.

Additives which can be used in the present invention include, in addition to the above compounds, a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, imidazole or derivatives thereof; and a physical development unevenness inhibitor such as a heterocyclic mercapto compound (e.g., sodium 3-(5-mercaptotetrazol-1-yl)benzene sulfonate, 1-phenyl-5-mercaptotetrazole) and the compounds disclosed in JP-A-62-212651.

In addition to the compounds according to the present invention, mercapto based compounds, indazole based compounds, benzotriazole based compounds and benzimidazole based compounds can be used as an antifoggant or a black pepper inhibitor. Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, chlorobenzotriazole, bromobenzotriazole, nitrobenzotriazole, and methylbenzotriazole. The addition amount of these compounds is, in general, from 0.01 to 10 mmol, more preferably from 0.05 to 2 mmol, per liter of the developing solution.

Further, various kinds of organic and inorganic chelating agents can be used alone or in combination in the developing solution of the present invention.

Examples of inorganic chelating agents include sodium tetrapolyphosphate and sodium hexametaphosphate.

On the other hand, as organic chelating agents, organic carboxylic acid, aminopolycarboxylic acid, organic phosphonic acid, aminophosphonic acid, and organic phosphonocarboxylic acid can be primarily used.

Examples of organic carboxylic acids include acrylic acid, oxalic acid, malonic acid, succinic acid, glutaric acid, gluconic acid, adipic acid, pimelic acid, aci-elaidic acid, sebacic acid, nonanedicarboxylic acid, decanedicarboxylic acid, undecanedicarboxylic acid, maleic acid, itaconic acid, malic acid, citric acid, and tartaric acid.

Examples of aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds disclosed in JP-A-52-25632, JP-A-55-67747, JP-A-57-102624, and JP-B-53-40900.

Examples of organic phosphonic acids include the hydroxyalkylidene-diphosphonic acids disclosed in U.S. Pat. Nos. 3,214,454, 3,794,591 and West German Patent Publication No. 2,227,639, and the compounds disclosed in *Research Disclosure,* Vol. 181, Item 18170 (May, 1979).

Examples of aminophosphonic acids include aminotris (methylenephosphonic acid), ethylenediaminetetramethylenephosphonic acid, aminotrimethylenephosphonic acid, etc., and the compounds disclosed in *Research Disclosure*, No. 18170, JP-A-57-208554, JP-A-54-61125, JP-A-55-29883 and JP-A-56-97347.

Examples of organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, No. 18170.

These organic and/or inorganic chelating agents are not limited to the above-described compounds and they may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

Further, the developing solution can contain the following compounds as an agent for preventing silver contamination, in addition to the compound represented by formula (I), for example, triazine having one or more mercapto groups (e.g., trimercaptotriazine, dimercaptotriazine, mercaptotriazine, 2-hydroxy-4,6-dimercaptotriazine), pyrimidine having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine), pyridine having one or more mercapto groups (e.g., 2-mercaptopyridine, 2,6-dimercaptopyridine, 3,5-dimercaptopyridine, 2,4,6-trimercaptopyridine, the compounds disclosed in JP-A-7-248587), pyrazine having one or more mercapto groups (e.g., 2-mercaptopyrazine, 2,6-dimercaptopyrazine, 2,3-dimercaptopyrazine, 2,3,5-trimercaptopyrazine), pyridazine having one or more mercapto groups (e.g., 3-mercaptopyridazine, 3,4-dimercaptopyridazine, 3,5-dimercaptopyridazine, 3,4,6-trimercaptopyridazine), triazole having one or more mercapto groups (e.g., mercaptotriazole, dimercaptotriazole, 1-methyl-2,5-dimercaptotriazole), thiadiazole having one or more mercapto groups (e.g., 2-mercaptothiadiazole, 2,5-dimercaptothiadiazole), the compounds disclosed in JP-A-7-175177, and polyoxyalkylphosphonate disclosed in U.S. Pat. No. 5,457,011. These silver contamination preventing agents can be used alone or in combination of two or more, and they are used in an amount of preferably from 0.05 to 10 mmol, more preferably from 0.1 to 5 mmol, per liter of the developing solution.

Further, the compounds disclosed in JP-A-61-267759 can be used as a dissolution aid.

Further, if necessary, the developing solution may contain a toning agent, a surfactant, a defoaming agent and a hardening agent.

The pH of the developing solution is preferably from 9.0 to 10.8, and particularly preferably from 9.5 to 10.8. As an alkali agent which is used for adjusting pH, water-soluble inorganic alkali metal salts generally used (e.g., sodium hydroxide, potassium hydroxide, sodium carbonate, potassium carbonate) can be used.

As the cation in a developing solution, a potassium ion does not inhibit development so much as a sodium ion does, and provides less fringes around the blackened part compared with a sodium ion. Further, when a developing solution is preserved as a concentrated solution, a potassium salt has, in general, higher solubility and preferred. However, since a potassium ion in a fixing solution inhibits fixation in the same degree as a silver ion does, if the potassium ion concentration in a developing solution is high, the potassium ion concentration in a fixing solution becomes high by the developing solution carried over with a photographic material, which is not preferred. Accordingly, the molar ratio of the potassium ion to the sodium ion in a developing solution is preferably from 20/80 to 80/20. The ratio of the potassium ion to the sodium ion in a developing solution can be arbitrarily adjusted within the above range by the counter cation of a pH buffer, a pH adjustor, a preservative, a chelating agent, etc.

The replenishing rate of a developing solution is generally 330 ml or less, preferably from 50 to 325 ml, per $m^2$ of the photographic material. The composition and/or the concentration of a developing replenisher may be the same as or different from those of a developing starter.

Ammonium thiosulfate, sodium thiosulfate and sodium ammonium thiosulfate can be used as the fixing agent of fixing processing chemicals in the present invention. The amount used of the fixing agent can be varied arbitrarily and is generally from about 0.7 to about 3.0 mol/liter.

The fixing solution according to the present invention may contain a water-soluble aluminum salt and a water-soluble chromium salt having a function as a hardening agent. Preferred compounds are a water-soluble aluminum salt, e.g., aluminum chloride, aluminum sulfate, potassium alum, aluminum ammonium sulfate, aluminum nitrate, aluminum lactate and aluminum gluconate. They are preferably contained in an amount of from 0.01 to 0.15 mol/liter in terms of an aluminum ion concentration in the working solution.

When the fixing solution is preserved as a concentrated solution or a solid agent, it may comprise a plurality of parts with a hardening agent being a separate part or it may comprise one part type including all the components.

The fixing processing chemicals can contain, if desired, a preservative (e.g., sulfite, bisulfite or metabisulfite, in an amount of 0.015 mol/liter or more, preferably from 0.02 mol/liter to 0.3 mol/liter), a pH buffer (e.g., acetic acid, sodium acetate, sodium carbonate, sodium hydrogencarbonate, phosphoric acid, succinic acid, and adipic acid, in an amount of from 0.1 mol/liter to 1 mol/liter, preferably from 0.2 mol/liter to 0.7 mol/liter), and a compound having stabilizing capability of aluminum and hard water softening capability (e.g., gluconic acid, iminodiacetic acid, 5-sulfosalicylic acid, glucoheptanic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts of these compounds, saccharides and boric acid in an amount of from 0.001 mol/liter to 0.5 mol/liter, preferably from 0.005 mol/liter to 0.3 mol/liter).

The fixing processing chemicals can contain, if desired, the compounds disclosed in JP-A-62-78551, a pH adjustor (e.g., sodium hydroxide, ammonia, sulfuric acid), a surfactant, a wetting agent, and a fixing accelerator. Specific examples of surfactants include an anionic surfactant (e.g., a sulfated product, a sulfonated product), a polyethylene surfactant, and amphoteric surfactants disclosed in JP-A-57-6840, and known defoaming agents can also be used. Specific examples of the wetting agents include alkanolamine and alkylene glycol. Specific examples of the fixing accelerators include alkyl- and aryl-substituted thiosulfonic acid and salts thereof, thiourea derivatives disclosed in JP-B-45-35754, JP-B-58-122535 and JP-B-58-122536, an alcohol having a triple bond in the molecule, thioether compounds disclosed in U.S. Pat. No. 4,126,459, mercapto compounds disclosed in JP-A-1-4739, JP-A-1-159645 and JP-A-3-101728, mesoionic compounds disclosed in JP-A-4-170539, and thiocyanate.

The pH of the fixing solution for use in the present invention is preferably 4.0 or more and more preferably from 4.5 to 7.0. The pH of the fixing solution rises according to processing by the mixture of a developing solution. In such a case the pH of a hardening fixing solution is 6.0 or less, preferably 5.7 or less, and that of a non-hardening fixing solution is 7.0 or less, preferably 6.7 or less.

The replenishing rate of the fixing solution is preferably 500 ml/$m^2$ or less, more preferably 390 ml/$m^2$ or less, and still more preferably from 80 to 320 ml/$m^2$, of the photographic material processed. The compositions and/or the concentration of the fixing replenisher may be the same as or different from those of the fixing starter.

Silver recovery from a fixing solution can be carried out according to known fixing solution reclaiming methods, such as electrolytic silver recovery, and the regenerated solution after the silver recovery can be used in the present invention. The replenishing rate of the fixing solution can be reduced to 200 ml/$m^2$ or less by reclaiming. As such a reclaiming device, Reclaim R-60 produced by Fuji Hunt Co., Ltd. can be cited.

Further, the removal of dyes and the like using an adsorptive filter such as an activated carbon is also preferred.

When the developing and fixing processing chemicals of the present invention are solutions, they are preferably preserved in packaging materials of low oxygen permeation as disclosed in JP-A-61-73147. Further, when these solutions are concentrated solutions, they are diluted with water to a predetermined concentration in the ratio of from 0.2 to 3 parts of water to one part of the concentrated solutions.

If the developing processing chemicals and fixing processing chemicals of the present invention are solids, the same effects as solutions can be obtained. Solid processing chemicals are described below.

Solid chemicals for use in the present invention may be made into known shapes such as powders, granular powders, granules, lumps, tablets, compactors, briquettes, sheets, bars or paste. These solid chemicals may be covered with water-soluble coating agents or films to separate components which react with each other on contact, or they may comprise a multilayer structure to separate components which react with each other, or both types may be used in combination.

Known coating agents and auxiliary granulating agents can be used, but polyvinyl pyrrolidone, polyethylene glycol, polystyrene sulfonic acid and vinyl compounds are preferred. Line 48, column 2 to line 13, column 3 of JP-A-5-45805 can be referred to.

When a multilayer structure is used, components which do not react with each other on contact may be sandwiched with components which react with each other and made into tablets and briquettes, or components of known shapes may be made to similar layer structure and packaged. Methods thereof are disclosed in JP-A-61-259921, JP-A-4-16841, JP-A-4-78848 and JP-A-5-93991.

The bulk density of the solid processing chemicals is preferably from 0.5 to 6.0 g/$cm^3$, in particular, the bulk density of tablets is preferably from 1.0 to 5.0 g/$cm^3$ and that of granules is preferably from 0.5 to 1.5 g/$cm^3$.

Solid processing chemicals can be produced using any known method, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5- 197070, JP-A-5-204098, JP-A-5-224361, JP-A-6-138604, JP-A-6-138605 and JP-A-8-286329 can be referred to.

Specifically, a rolling granulating method, an extrusion granulating method, a compression granulating method, a cracking granulating method, a stirring granulating method, a spray drying method, a dissolution coagulation method, a briquetting method, and a roller compacting method can be used.

The solubility of the solid chemicals can be adjusted by changing the state of the surface (smooth, porous, etc.) and the thickness partially, or making the shape to a hollow doughnut type. Further, it is possible to provide different solubilities to a plurality of granulated products, or it is also possible for materials having different solubilities to take various shapes to coincide with solubilities thereof. Multilayer granulated products having different compositions between the inside and the surface can also be used.

Packaging materials of solid chemicals preferably have low oxygen and water permeabilities and bag-like, cylindrical and box-like shapes can be used. Packaging materials of foldable shapes are preferred for saving storage space of waste materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, a pull-top or an aluminum seal, or packaging materials may be heat-sealed, or other known types may be used, and there are no particular limitations. Waste packaging materials are preferred to be recycled for reclaiming or reused from the environmental protection.

Methods of dissolution and replenishment of the solid processing chemicals are not particularly limited and known methods can be used. Examples of these known methods include a method in which a certain amount of processing chemicals are dissolved and replenished by a dissolving device having a stirring function, a method in which processing chemicals are dissolved by a dissolving device having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed to a dissolving tank equipped in an automatic processor in proportion to the progress of the processing of photographic materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by the dissolving device provided with opening mechanism as disclosed in JP-A-9-138495, or by an automatic processor. The latter is preferred from the work environment. Specifically, there are methods of pushing through, unsealing, cutting off, and bursting the takeout port of a package, and methods disclosed in JP-A-6-19102 and JP-A-6-95331.

A photographic material is subjected to washing or stabilizing processing after being development processed and fixing processed (hereinafter washing includes stabilization processing and the solution used therefor is called water or washing water unless otherwise indicated). The water which is used for washing may be any of city water, ion exchange water, distilled water, and stabilizing solution. The replenishing rate thereof is, in general, from about 8 liters to about 17 liters per $m^2$ of the photographic material, but washing can be carried out with the less replenishing rate. In particular, with a replenishing rate of 3 liters or less (including zero, i.e., washing in a reservoir), not only water saving processing can be carried out but also piping for installation of an automatic processor is not required. When washing is carried out with a reduced amount of water, it is preferred to use a washing tank equipped with a squeegee roller or a crossover roller disclosed in JP-A-63-18350 and JP-A-62-287252. The addition of various kinds of oxidizing agents (e.g., ozone, hydrogen peroxide, sodium hypochlorite, activated halogen, chlorine dioxide, sodium carbonate hydrogen peroxide) and the provision of filters for filtration may be combined to reduce load in environmental pollution which becomes a problem when washing is carried out with a small amount of water and to prevent generation of scale.

As a means of reducing the replenishing rate of the washing water, a multistage countercurrent system (e.g., two stages or three stages) has been known. The replenishing rate of the washing water in this system is preferably from 50 to 200 ml per $m^2$ of the photographic material. This is also effective in an independent multistage system (a method which is not a countercurrent system and fresh solution is replenished separately to multistage washing tanks).

Further, a means of preventing generation of scale may be included in a washing process. A means of preventing generation of scale is not particularly limited and known methods can be used, such as a method of adding antimold agents (a scale preventive), a method by electroconduction, a method of irradiating ultraviolet ray or infrared ray and far infrared ray, a method of making the magnetic field, a method by ultrasonic wave processing, a method by heating, and a method of emptying tanks when they are not used. These scale preventing means may be conducted in proportion to the progress of the processing of photographic materials, may be conducted at regular intervals irrespective of usage conditions, or may be conducted only during the time when processing is not conducted, for example, during night. In addition, washing water previously provided with such a means may be replenished. It is also preferred to conduct different scale preventing means for every given period of time for inhibiting the proliferation of resisting fungi. An antimold agent is not particularly limited and known antimold agents can be used. Examples thereof include, for example, a chelating agent such as glutaraldehyde and aminopolycarboxylic acid, cationic surfactants, and mercaptopyridine oxide (e.g., 2-mercaptopyridine-N-oxide), in addition to the above-described oxidants, and they can be used alone or in combination of two or more.

Methods by electroconduction disclosed in JP-A-3-224685, JP-A-3-224687, JP-A-4-16280 and JP-A-4-18980 can be used in the present invention.

Moreover, known water-soluble surfactants or defoaming agents may be contained in washing water for preventing generation of irregulars due to foaming and transfer of stains. In addition, dye-adsorbents disclosed in JP-A-63-163456 may be included in a washing tank to inhibit contamination by dyes dissolved out from photographic materials.

All or a part of the overflow from the washing process can be utilized by mixture in the processing solution having fixing ability as disclosed in JP-A-60-235133. It is also preferred from the environmental protection for a washing solution to be processed by various processes before draining, for example, biochemical oxygen demand (BOD), chemical oxygen demand (COD), iodine consumption, etc., are reduced by a microorganism process (e.g., processes using sulfur oxide fungus and activated sludge, a process using a filter of a porous carrier, such as activated carbon or ceramic, carrying microorganisms) and an oxidation process by electroconduction and oxidants, or silver is precipitated by adding a compound which forms a hardly soluble silver complex such as trimercaptotriazine and filtrated using a filter of a polymer having affinity with silver and to reduce the silver concentration in water drained.

Also, when a photographic material is subjected to stabilizing processing after washing processing, a bath containing compounds disclosed in JP-A-2-201357, JP-A-2-132435, JP-A-1-102553 and JP-A-46-44446 may be used as a final bath. This stabilizing bath may also contain, if desired, ammonium compounds, metal compounds such as Bi and Al, brightening agents, various kinds of chelating agents, film pH adjustors, hardening agents, sterilizers, antimold agents, alkanolamines, and surfactants.

Additives such as antimold agents and stabilizing agents which are added to a washing bath and a stabilizing bath can also be solid agents same as the above-described developing and fixing processing chemicals.

Waste solutions of the developing solution, fixing solution, washing water and stabilizing solution for use in the present invention are preferably subjected to incineration disposal. It is also possible to discard these waste solutions as concentrated solutions concentrated by concentrators as disclosed in JP-B-7-83867 and U.S. Pat. No. 5,439,560, or as solids.

In the case when the replenishing rate is reduced, it is preferred to prevent evaporation and air oxidation of the solution by minimizing the open area of the processing tank. A roller transporting type automatic processor is disclosed in U.S. Pat. Nos. 3,025,779 and 3,545,971 and referred to as merely a roller transporting type processor in the specification of the present invention. A roller transporting type processor comprises four steps of development, fixation, washing and drying and, although the method of the present invention does not exclude other steps (e.g., stopping step), it is most preferred to follow this four step system. Further, a rinsing bath may be provided between development and fixation and/or between fixation and washing.

Development processing according to the present invention is preferably carried out by development processing of dry to dry of from 25 to 160 seconds, with development and fixing time being 40 seconds or less, preferably from 6 to 35 seconds, the temperature of each processing solution being from 25 to 50° C., preferably from 30 to 40° C. The temperature and time of washing is preferably from 0 to 50° C. and 40 seconds or less, respectively. According to the method of the present invention, photographic materials having been developed, fixed and washed may be dried after the water content is squeezed out of the materials, that is, through squeegee rollers. The drying step is carried out at a temperature of from about 40 to about 100° C. and the time therefor can vary properly depending upon the surroundings. Drying methods are not particularly limited and any known methods can be used, such as a warm air drying method, the heated roller drying method and the far infrared ray drying method disclosed in JP-A-4-15534, JP-A-5-2256 and JP-A-5-289294 and a plurality of methods can be used in combination.

The present invention will be described in greater detail below with reference to the specific examples, but the invention should not be construed as being limited thereto.

EXAMPLE 1

| Preparation of Emulsion | |
|---|---|
| Solution 1 | |
| Water | 750 ml |
| Gelatin | 20 g |
| Sodium Chloride | 2 g |
| 1,3-Dimethylimidazolidine-2-thione | 20 mg |
| Sodium Thiosulfonate | 10 mg |
| Solution 2 | |
| Water | 300 ml |
| Silver Nitrate | 150 g |
| Solution 3 | |
| Water | 300 ml |
| Sodium Chloride | 34 g |
| Potassium Bromide | 32 g |
| Potassium Hexachloroiridate | 0.25 mg |
| Ammonium Hexabromorhodate | 0.06 mg |
| Yellow Prussiate of Potash | 5 mg |

Solution 2 and Solution 3 in the amounts corresponding to 90% of each were simultaneously added to Solution 1 maintained at 38° C. and pH 4.5 over a period of 20 minutes with stirring, and nucleus grains having a diameter of 0.16 μm were formed. Subsequently, Solution 4 and Solution 5 shown below were added over a period of 8 minutes. Further, the remaining amounts of 10% of Solution 2 and Solution 3 were added over a period of 2 minutes, thereby the diameter of grains was grown to 0.18 μm. Further, 0.15 g of potassium iodide was added and the grain formation was completed.

| | |
|---|---|
| Solution 4 | |
| Water | 100 ml |
| Silver Nitrate | 50 g |
| Solution 5 | |
| Water | 100 ml |
| Sodium Chloride | 14 mg |
| Potassium Bromide | 11 mg |
| Potassium Ferrocyanide | 5 mg |

The resulting emulsion was washed according to the ordinary flocculation method and 45 g of gelatin was added. pH was adjusted to 5.6 and pAg was adjusted to 7.5. Then, 10 mg of sodium thiosulfonate, 3 mg of sodium thiosulfinate, 1 mg of sodium thiosulfate, 1 mg of triphenylphosphine selenide and 5 mg of chloroauric acid were added, and optimal chemical sensitization was carried out at 55° C. Further, 200 mg of 1,3,3a,7-tetraazaindene was added as a stabilizer.

The finally obtained grains were cubic silver iodochlorobromide grains having an average grain size of 0.18 μm, a silver chloride content of 70 mol % and a silver iodide content of 0.08 mol % (variation coefficient: 9%).

To the emulsion obtained were added the sensitizing dye of the present invention as shown in Table 1 per mol of Ag, KBr and KI in amounts of 5 g, respectively, and further hydroquinone as a sensitizer, and the following Compounds (a), (b) and (c), in amounts of 5 g, 0.2 g, 0.2 g and 1 g, respectively.

(a)

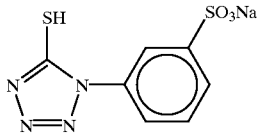

(b)

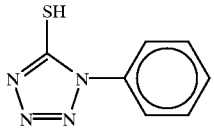

(c)

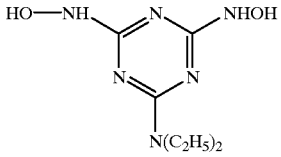

Further, to the above emulsion were added Compound 2b shown above as a nucleating agent in an amount of $1\times10^{-4}$ mol, and 0.2 g of the above Compound A-6 as a nucleation accelerating agent. Subsequently, 0.4 g of sodium dodecylbenzenesulfonate, polyethyl acrylate latex and colloidal silica having a particle diameter of 0.01 $\mu$m in the amounts corresponding to 30%, respectively, based on the gelatin binder, 100 mg/m$^2$ of water-soluble Latex (d), 150 mg/m$^2$ of polyethyl acrylate dispersion, 150 mg/m$^2$ of a latex copolymer of methyl acrylate/sodium 2-acrylamido-2-methylpropanesulfonate/2-acetoacetoxyethyl methacrylate (88/5/7 by weight), 150 mg/m$^2$ of a core/shell type latex (core: a styrene/butadiene copolymer (37/63 by weight), shell: a styrene/2-acetoacetoxyethyl methacrylate copolymer (84/16 by weight), core/shell ratio: 50/50), and 4%, based on the gelatin binder, of 2-bis (vinylsulfonylacetamido)ethane as a hardening agent were added thereto. The pH value of the emulsion was adjusted to 5.5 with citric acid. The thus-obtained coating solution was coated on an undercoated polyester support having a moistureproof layer containing vinylidene chloride to provide a coated silver weight of 3.2 g/m$^2$ and a coated gelatin weight of 1.4 g/m$^2$. Samples were prepared with varying the kinds of sensitizing dyes as shown in Table 1. An upper protective layer and a lower protective layer each having the composition shown below were coated on this support and a UL layer having the composition shown below was coated beneath the lower protective layer.

| | |
|---|---|
| Upper Protective Layer | |
| Gelatin | 0.3 g/m$^2$ |
| Silica Matting Agent (average particle size: 3.5 $\mu$m) | 25 mg/m$^2$ |
| Compound (e) (gelatin dispersion) | 20 mg/m$^2$ |
| Colloidal Silica (particle size: 10 to 20 $\mu$m) | 30 mg/m$^2$ |
| Compound (f) | 5 mg/m$^2$ |
| Sodium Dodecylbenzenesulfonate | 20 mg/m$^2$ |
| Compound (g) | 20 mg/m$^2$ |
| Lower Protective Layer | |
| Gelatin | 0.5 g/m$^2$ |

-continued

| | |
|---|---|
| Compound (h) | 15 mg/m$^2$ |
| 1,5-Dihydroxy-2-benzaldoxime | 10 mg/m$^2$ |
| Polyethyl Acrylate Latex | 150 mg/m$^2$ |
| UL Layer | |
| Gelatin | 0.5 g/m$^2$ |
| Polyethyl Acrylate Latex | 150 mg/m$^2$ |
| Compound (i) | 40 mg/m$^2$ |
| Compound (j) | 10 mg/m$^2$ |

The support of the sample which was used in the present invention had the backing layer and the conductive layer having the following compositions.

| | |
|---|---|
| Backing Layer | |
| Gelatin | 3.3 g/m$^2$ |
| Sodium Dodecylbenzenesulfonate | 80 mg/m$^2$ |
| Compound (k) | 40 mg/m$^2$ |
| Compound (l) | 20 mg/m$^2$ |
| Compound (m) | 90 mg/m$^2$ |
| 1,3-Divinylsulfonyl-2-propanol | 60 mg/m$^2$ |
| Polymethyl Methacrylate Fine Particles (average particle size: 6.5 $\mu$m) | 30 mg/m$^2$ |
| Compound (e) | 120 mg/m$^2$ |
| Conductive Layer | |
| Gelatin | 0.1 g/m$^2$ |
| Sodium Dodecylbenzenesulfonate | 20 mg/m$^2$ |
| $SnO_2$/Sb (9/1 by weight, average grain size: 0.25 $\mu$m) | 200 mg/m$^2$ |

(d)

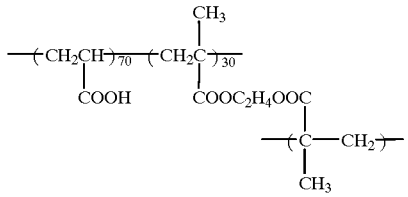

(e)

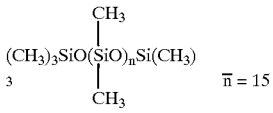

(f)

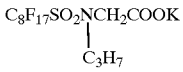

(g)

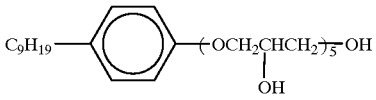

-continued (h)

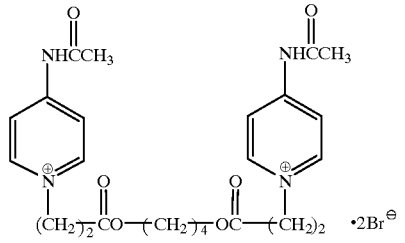

(j)

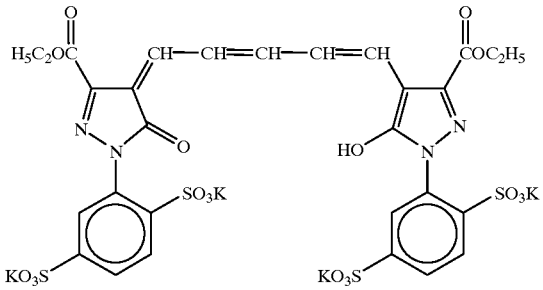

(k)

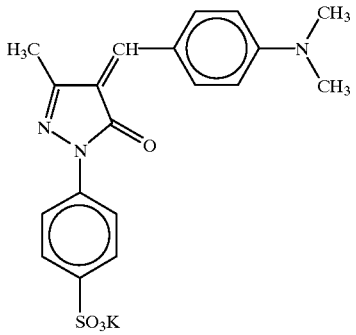

(l)

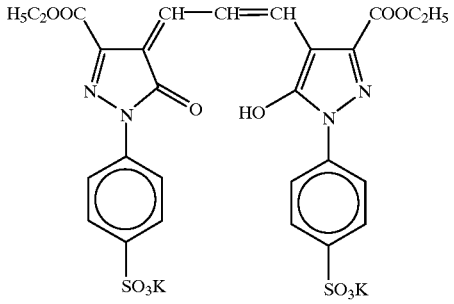

(m)

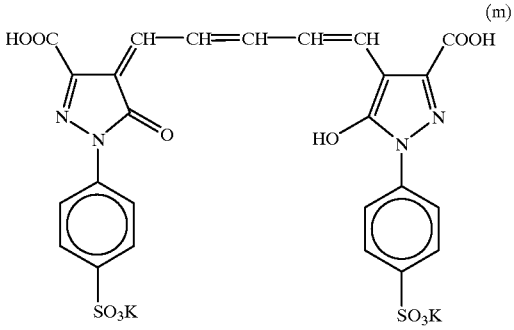

The following dye was used as a comparative dye.

Comparative Dye

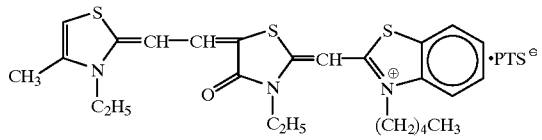

The composition per liter of the concentrated developing solution (1) is shown below.

| | |
|---|---|
| Potassium Hydroxide | 105.0 g |
| Diethylenetriaminepentaacetic Acid | 6.0 g |
| Potassium Carbonate | 120.0 g |
| Sodium Metabisulfate | 120.0 g |
| Potassium Bromide | 9.0 g |
| Hydroquinone | 75.0 g |
| 5-Methylbenzenetriazole | 0.25 g |
| 4-Hydroxymethyl-4-methyl-1-phenyl-3-pyrazolidone | 1.35 g |
| Compound Represented by Formula (I) | the concentration in the working solution is shown in Table 1 |
| Sodium Erythorbate | 9.0 g |
| Diethylene Glycol | 60.0 g |
| pH | 10.7 |

One part of the above concentrated solution is diluted with 2 parts of water for use. The pH of the working solution is 10.5.

The following compound was used as a silver contamination preventing agent for comparison.

Comparison 1

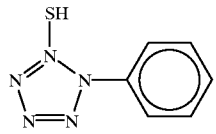

Comparison 2

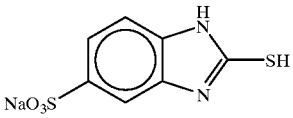

The composition per liter of the concentrated fixing solution (1) is shown below.

| | |
|---|---|
| Ammonium Thiosulfate | 360 g |
| Disodium Ethylenediaminetetraacetate Dihydrate | 0.09 g |
| Sodium Thiosulfate Pentahydrate | 33.0 g |
| Sodium Metasulfite | 57.0 g |
| Sodium Hydroxide | 37.2 g |
| Acetic Acid (100%) | 90.0 g |
| Tartaric Acid | 8.7 g |
| Sodium Gluconate | 5.1 g |
| Aluminum Sulfate | 25.2 g |
| pH | 4.85 |

One part of the above concentrated solution is diluted with 2 parts of water for use. The pH of the working solution is 4.8.

Flakes of ammonium thiosulfate (compact) produced by a spray drying method were compressed by the application of pressure using a roller compactor and crushed to an amorphous chips having a length of about 4 to 6 mm, then blended with sodium thiosulfuric anhydride. As for other raw material powders, general industrial products were used.

Ten liter portion of each of Agent A and Agent B was filled in a foldable container made of high density polyethylene and the takeout port of Agent A was sealed with an aluminum seal. The mouth of the container of Agent B was sealed with a screw cap. The dissolving and replenishing device having an automatic opening mechanism as disclosed in JP-A-9-80178 and JP-A-9-138495 was used for the dissolution and replenishment.

Evaluation of Photographic Capabilities

Each of the samples obtained was exposed with xenon flash light of emission time of $10^{-6}$ sec. through an interference filter which had a peak at 633 nm and through a step wedge, subjected to development (35° C., 30 sec.) using automatic processor FG-680AG (produced by Fuji Photo Film Co., Ltd.) and sensitometry was carried out.

The reciprocal of the exposure required to give a density of 1.5 was taken as the sensitivity and the result of the sensitivity evaluation is shown as a relative value. The gradient of the straight line joining the points of density 0.1 and density 3.0 of the characteristic curve was taken as gradation.

Evaluation of Practical Density

Test pattern (16 stages) of 175 line/inch was outputted with varying LS value (light step value) using helium-neon light source color scanner SG-608 produced by Dai Nippon Screen Mfg. Co., Ltd. and development processing was carried out by the above processing conditions. Practical density means Dmax measured at exposure with LS value reproducing 49% of dot area percentage of the eighth stage of the test pattern. Dot area percentage and practical density were measured using Macbeth TD904.

Evaluation of Silver Contamination

Each sample was exposed so as to reach blackening ratio of 20%, and processed at a rate of 100 $m^2$/day for 10 days using FG-680AG automatic processor at development and fixing temperatures of 35° C. and 34° C. respectively for 30 seconds of developing time with the replenishing rate of the developing replenisher and the fixing replenisher being 160 ml/$m^2$, respectively, and that of washing water being 6 liters/$m^2$. After the processing, the state of generation of sludge in the developing tank and on the developing roller was observed visually, further, photographic paper KU-15OWP (6 cm×30.3 cm) (a product of Fuji Photo Film Co., Ltd.) was processed and the contamination of the photographic material was visually observed and evaluated by five grades. Grade "5" means best and "1" means worst. "5" and "4" are practicable, "3" is coarse but within the limit of practicable level, and "2" and "1" are impracticable.

TABLE 1

| | Compound of Formula (I) | | Sensitizing Dye | | | | | | | |
|---|---|---|---|---|---|---|---|---|---|---|
| No. | Kind | Amount Added (mM/l) | Kind | Amount Added (mg/molAg) | Silver Contamination | Sensitivity | Fog | Gradation | Practical Density | Remarks |
| 1 | None | — | II-1 | 150 | 1 | 100 (control) | 0.05 | 20 | 5.2 | |
| 2 | I-6 | 1 | II-1 | 150 | 5 | 98 | 0.04 | 20 | 5.1 | Invention |
| 3 | I-19 | 1 | II-1 | 150 | 5 | 97 | 0.04 | 20 | 5.2 | Invention |
| 4 | I-21 | 1 | II-1 | 150 | 5 | 98 | 0.04 | 20 | 5.1 | Invention |
| 5 | I-22 | 1 | II-1 | 150 | 5 | 96 | 0.04 | 21 | 5.1 | Invention |
| 6 | I-31 | 1 | II-1 | 150 | 5 | 97 | 0.04 | 20 | 5.2 | Invention |
| 7 | I-38 | 1 | II-1 | 150 | 5 | 98 | 0.04 | 19 | 5.2 | Invention |
| 8 | I-44 | 1 | II-1 | 150 | 5 | 96 | 0.04 | 20 | 5.2 | Invention |
| 9 | I-45 | 1 | II-1 | 150 | 5 | 98 | 0.04 | 20 | 5.1 | Invention |
| 10 | I-52 | 1 | II-1 | 150 | 5 | 97 | 0.04 | 20 | 5.2 | Invention |
| 11 | I-19 | 1 | III-1 | 150 | 5 | 95 | 0.04 | 19 | 5.1 | Invention |
| 12 | I-19 | 1 | IV-10 | 150 | 5 | 93 | 0.04 | 19 | 5.2 | Invention |
| 13 | I-19 | 1 | V-1 | 150 | 5 | 92 | 0.04 | 19 | 5.1 | Invention |
| 14 | I-19 | 1 | Comparative dye | 150 | 5 | 88 | 0.10 | 16 | 4.7 | Comparison |
| 15 | I-31 | 1 | III-1 | 150 | 5 | 94 | 0.04 | 19 | 5.2 | Invention |
| 16 | I-31 | 1 | IV-10 | 150 | 5 | 93 | 0.04 | 18 | 5.1 | Invention |
| 17 | I-31 | 1 | V-1 | 150 | 5 | 92 | 0.04 | 18 | 5.2 | Invention |
| 18 | I-31 | 1 | Comparative dye | 150 | 5 | 87 | 0.10 | 15 | 4.7 | Comparison |
| 19 | Comparison 1 | 0.5 | II-1 | 150 | 4 | 78 | 0.04 | 17 | 4.8 | Comparison |
| 20 | Comparison 1 | 1 | II-1 | 150 | 5 | 65 | 0.04 | 13 | 4.2 | Comparison |
| 21 | Comparison 1 | 1 | Comparative dye | 150 | 5 | 78 | 0.08 | 15 | 4.6 | Comparison |
| 22 | Comparison 2 | 1 | II-1 | 150 | 3 | 93 | 0.04 | 19 | 5.0 | Comparison |
| 23 | Comparison 2 | 2 | II-1 | 150 | 4 | 88 | 0.04 | 18 | 4.8 | Comparison |

When the processing is conducted with a developing solution not containing a silver contamination preventing agent, sensitivity and practical density are high but silver contamination is serious and impracticable. If comparative silver contamination preventing agents are used, silver contamination becomes practicable level when the use amount is increased, but this is accompanied with low sensitivity, low contrast and the reduction of practical density. On the contrary, when the compound represented by formula (I) according to the present invention is used, silver contamination is not generated, and besides, photographic capabilities of high sensitivity, high contrast and high practical density can be attained. It is understood that more excellent capabilities can be obtained by the combination with the dyes according to the present invention.

EXAMPLE 2

A coated sample was prepared by coating the coating solution in Example 1 on the support in Example 3 of JP-A-8-211532 (related U.S. application Ser. No. 08/595,478) and evaluated by the conditions in Examples 1 and 2. The same results as in Example 1 were obtained.

EXAMPLE 3

Sample Nos. 4-1 to 4-17 were prepared in the same manner as in Example 1 except for using a polyester support having the thickness of 175 $\mu$m and changing the amount of gelatin for an underlayer to 1.5 g/m$^2$ and the amount of Dye (f) to 40 mg/m$^2$ and the same test as in Example 1 was carried out. The same results as in Example 1 were obtained. Further, when a polyester support having the thickness of 175 $\mu$m and not having a moistureproof layer containing vinylidene chloride and the underlayer of which was changed as described above was used, the same results were obtained.

EXAMPLE 4

When processing was conducted at developing and fixing temperatures of 38° C. and 37° C., respectively, for 20 seconds of developing time, the same results as in Example 1 were obtained, therefore, the effect of the present invention was not changed.

EXAMPLE 5

In Examples 1 to 3, the same processing was conducted using automatic processor FG-680AS, a product of Fuji Photo Film Co., Ltd., at transporting speed of the material of linear velocity of 1,500 mm/min. The same results were obtained.

EXAMPLE 6

The same tests as in Examples 1 to 5 were conducted using the solid developing agent (developing solution (2)) and the solid fixing agent (fixing solution (2)). The same results were obtained. The compound represented by formula (I) was used as in Table 1 and evaluated.

The composition of the solid developing agent is shown below.

| | |
|---|---|
| Sodium Hydroxide (beads, 99.5%) | 11.5 g |
| Potassium Sulfite (raw material powder) | 63.0 g |
| Sodium Sulfite (raw material powder) | 46.0 g |
| Potassium Carbonate | 62.0 g |
| Hydroquinone (briquette) | 40.0 g |

The following are briquetted together.

| | |
|---|---|
| Diethylenetriaminepentaacetic Acid | 2.0 g |
| 5-Methylbenzenetriazole | 0.35 g |
| 4-Hydroxymethyl-4-methyl-1-phenyl-3 pyrazolidone | 1.5 g |

-continued

| Compound Represented by Formula (I) | the concentration in the working solution is shown in Table 1 |
|---|---|
| Sodium 3-(5-Mercaptotetrazol-1-yl)-benzenesulfonate | 0.1 g |
| Sodium Erythorbate | 6.0 g |
| Potassium Bromide | 6.6 g |
| These components were dissolved in water to make | 1 liter |
| pH | 10.65 |

Raw material powders which were general industrial products were used as they were and beads of alkali metal salts were those commercially available.

Raw materials which were in the form of a briquette were compressed by the application of pressure using a briquetting machine and formed to a sheet, and they were crushed and used. With respect to small amount components, every components were blended and then made to a briquette.

Ten liter portion of the above processing chemicals was filled in a foldable container made of high density polyethylene and the takeout port was sealed with an aluminum seal. The dissolving and replenishing device having an automatic opening mechanism as disclosed in JP-A-9-80718 and JP-A-9-138495 was used for the dissolution and replenishment.

The composition of the solid fixing agent (fixing solution (2)) is shown below.

| | |
|---|---|
| Agent A (solid) | |
| Ammonium Thiosulfate (compact) | 125.0 g |
| Sodium Thiosulfuric Anhydride (raw material powder) | 19.0 g |
| Sodium Metabisulfite (raw material powder) | 18.0 g |
| Sodium Acetic Anhydride (raw material powder) | 42.0 g |
| Agent B (solution) | |
| Disodium Ethylenediaminetetraacetate Dihydrate | 0.03 g |
| Citric Anhydride | 3.7 g |
| Sodium Gluconate | 1.7 g |
| Aluminum Sulfate | 8.4 g |
| Sulfuric Acid | 2.1 g |
| These components were dissolved in water to make | 50 ml |
| Agents A and B were dissolved in water to make | 1 liter |
| pH | 4.85 |

EXAMPLE 7

The same tests as in Examples 1 to 3 were conducted using the following developing solution. The processor used was AP-560 automatic processor (a product of Fuji Photo Film Co., Ltd.), development and fixation were conducted at 38° C. and 37° C., respectively, developing time was 20 seconds, the replenishing rate of the developing replenisher was 80 ml/m$^2$, the fixing replenisher was 80 ml/m$^2$, and that of rinsing replenisher was 110 ml/m$^2$.

| Composition of Developing Solution | |
|---|---|
| Diethylenetriaminepentaacetic Acid | 2 g |
| Potassium Carbonate | 33 g |
| Sodium Carbonate | 28 g |

-continued

| Composition of Developing Solution | |
|---|---|
| Sodium Hydrogencarbonate | 25 g |
| Sodium Erythorbate | 45 g |
| N-Methyl-p-aminophenol | 7.5 g |
| KBr | 2 g |
| 5-Methylbenzenetriazole | 0.004 g |
| 1-Phenyl-5-mercaptotetrazole | 0.02 |
| Compound Represented by Formula (I) | the concentration in the working solution is shown in Table 2 |
| Sodium Sulfite | 2 g |
| Water to make | 1 liter |
| pH | 9.7 |

The results obtained are shown in Table 2. It can be understood that excellent results can be obtained from the samples of the present invention.

38° C. and 37° C., respectively, developing time was 20 seconds, the replenishing rate of the developing replenisher was 160 ml/m$^2$, the fixing replenisher was 130 ml/m$^2$, and that of washing replenisher was 3 liters/m$^2$. The same results as in Example 7 were obtained.

EXAMPLE 10

The compound represented by formula (I) of the present invention was coated on the backing layer of the sample in Example 1 in a coating weight of 100 mg/m$^2$ and evaluations in Examples 1 to 9 were conducted. The same silver contamination preventing effect was obtained.

According to the processing method of the present invention, a silver halide photographic material suitable for a scanner and an image setter having an He—Ne laser, a red semiconductor laser, an LED, etc., as a light source, which can stably provide photographic capabilities such as high sensitivity, high contrast and high Dmax even in running processing, and generates little silver sludge can be obtained.

TABLE 2

| | Compound of Formula (I) | | Sensitizing Dye | | | | | | | |
|---|---|---|---|---|---|---|---|---|---|---|
| No. | Kind | Amount Added (mM/l) | Kind | Amount Added (mg/molAg) | Silver Contamination | Sensitivity | Fog | Gradation | Practical Density | Remarks |
| 24 | None | — | II-1 | 150 | 1 | 100 (control) | 0.05 | 20 | 5.1 | |
| 25 | I-6 | 1 | II-1 | 150 | 5 | 97 | 0.04 | 20 | 5.1 | Invention |
| 26 | I-19 | 1 | II-1 | 150 | 5 | 96 | 0.04 | 20 | 5.2 | Invention |
| 27 | I-21 | 1 | II-1 | 150 | 5 | 97 | 0.04 | 20 | 5.1 | Invention |
| 28 | I-22 | 1 | II-1 | 150 | 5 | 95 | 0.04 | 21 | 5.2 | Invention |
| 29 | I-31 | 1 | II-1 | 150 | 5 | 96 | 0.04 | 20 | 5.2 | Invention |
| 30 | I-38 | 1 | II-1 | 150 | 5 | 98 | 0.04 | 19 | 5.2 | Invention |
| 31 | I-44 | 1 | II-1 | 150 | 5 | 95 | 0.04 | 20 | 5.1 | Invention |
| 32 | I-45 | 1 | II-1 | 150 | 5 | 97 | 0.04 | 20 | 5.1 | Invention |
| 33 | I-52 | 1 | II-1 | 150 | 5 | 96 | 0.04 | 20 | 5.2 | Invention |
| 34 | I-19 | 1 | III-1 | 150 | 5 | 95 | 0.04 | 19 | 5.1 | Invention |
| 35 | I-19 | 1 | IV-10 | 150 | 5 | 94 | 0.04 | 19 | 5.2 | Invention |
| 36 | I-19 | 1 | V-1 | 150 | 5 | 92 | 0.04 | 19 | 5.1 | Invention |
| 37 | I-19 | 1 | Comparative dye | 150 | 5 | 87 | 0.10 | 16 | 4.6 | Comparison |
| 38 | I-31 | 1 | III-1 | 150 | 5 | 93 | 0.04 | 19 | 5.2 | Invention |
| 39 | I-31 | 1 | IV-10 | 150 | 5 | 92 | 0.04 | 18 | 5.1 | Invention |
| 40 | I-31 | 1 | V-1 | 150 | 5 | 91 | 0.04 | 18 | 5.2 | Invention |
| 41 | I-31 | 1 | Comparative dye | 150 | 5 | 86 | 0.10 | 15 | 4.5 | Comparison |
| 42 | Comparison 1 | 0.5 | II-1 | 150 | 3 | 77 | 0.04 | 17 | 4.7 | Comparison |
| 43 | Comparison 1 | 1 | II-1 | 150 | 4 | 64 | 0.04 | 13 | 4.1 | Comparison |
| 44 | Comparison 1 | 1 | Comparative dye | 150 | 4 | 77 | 0.08 | 15 | 4.4 | Comparison |
| 45 | Comparison 2 | 1 | II-1 | 150 | 2 | 92 | 0.04 | 19 | 4.9 | Comparison |
| 46 | Comparison 2 | 2 | II-1 | 150 | 3 | 87 | 0.04 | 18 | 4.7 | Comparison |

EXAMPLE 8

Processing was conducted in Example 7 using automatic processor FG-680AS, a product of Fuji Photo Film Co., Ltd., at transporting speed of the material of linear velocity of 1,500 mm/min. The same results were obtained.

EXAMPLE 9

The same experiment as in Example 7 was conducted using automatic processor FG-680A, a product of Fuji Photo Film Co., Ltd. Development and fixation were conducted at While the invention has been described in detail and with reference to specific examples thereof, it will be apparent to one skilled in the art that various changes and modifications can be made therein without departing from the spirit and scope thereof.

What is claimed is:

1. A processing method comprising the steps of:

imagewise exposing a silver halide photographic material comprising a support having thereon at least one light-sensitive silver halide emulsion layer;

developing the exposed photographic material; and fixing the developed material;

wherein said developing is carried out in the presence of a compound represented by formula (A) or (B):

(A)

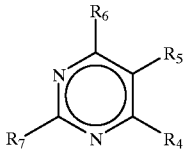

(B)

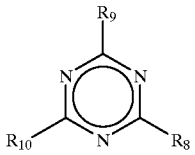

wherein $R_4$, $R_5$, $R_6$, $R_7$, $R_8$, $R_9$ and $R_{10}$, which may be the same or different, each represents a hydrogen atom, a halogen atom or a substituent bonded to the ring by any of a carbon atom, a nitrogen atom, an oxygen atom, a sulfur atom or a phosphorus atom, provided that at least two of $R_4$, $R_5$, $R_6$, and $R_7$ represent an —SM group (wherein M represents an alkali metal atom, a hydrogen atom or an ammonium group), wherein if $R_4$ and $R_5$ are bonded together to form a condensed ring, they are bonded together to form a condensed ring by condensation of a hydrocarbon ring or an aromatic ring;

wherein the compound represented by formula (A) or (B) is present in an amount of 0.01 to 10 mmol per liter of developing solution; and wherein the silver halide emulsion in said photographic material is spectrally sensitized with at least one dye represented by formula (II), (III), (IV) or (V):

(II)

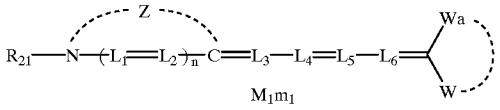

wherein $R_{21}$ represents an alkyl group; Z represents an atomic group necessary to form a 5- or 6-membered nitrogen-containing heterocyclic group; W and Wa represent atomic groups necessary to form an acyclic or cyclic acidic nucleus; $L_1$, $L_2$, $L_3$, $L_4$, $L_5$ and $L_6$ each represents a methine group; $M_1$ represents a counter ion necessary to neutralize a charge; $m_1$ represents a number of 0 or more necessary to neutralize a charge in the molecule; and n represents 0 or 1;

(III)

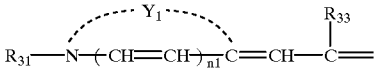

-continued

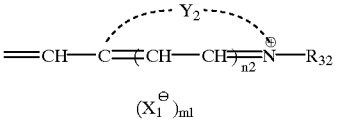

wherein $Y_1$ and $Y_2$ each represents a nonmetal atomic group necessary to form a benzothiazole ring, a benzoselenazole ring, a naphthothiazole ring, a naphthoselenazole ring or a quinoline ring, which may be substituted with a lower alkyl group, an alkoxyl group, an aryl group, a hydroxyl group, an alkoxycarbonyl group or a halogen atom; $R_{31}$ and $R_{32}$ each represents a lower alkyl group or an alkyl group having a sulfo group or a carboxyl group; $R_{33}$ represents a methyl group, an ethyl group or a propyl group; $X_1$ represents an anion; $n_1$ and $n_2$ each represents 0 or 1; and $m_1$ represents 1 or 0, and when an inner salt is formed $m_1$ represents 0;

(IV)

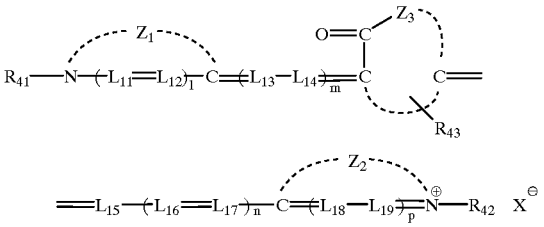

wherein $Z_1$ and $Z_2$ each represents an atomic group necessary to form a 5- or 6-membered heterocyclic ring; $Z_3$ represents an atomic group necessary to form a 5- or 6-membered nitrogen-containing heterocyclic ring, and the nitrogen atom in $Z_3$ has a substituent represented by $R_{43}$; $R_{41}$ and $R_{42}$ each represents an alkyl group, an alkenyl group, an aralkyl group or an aryl group; $R_{43}$ represents the same substituent as $R_{41}$ and $R_{42}$, or a substituted amino group, an amido group, an imino group, an alkoxyl group, an acyl group, an alkylsulfonyl group or a heterocyclic group, and at least one of $R_{41}$, $R_{42}$ and $R_{43}$ represents a water-soluble group; $L_{11}$, $L_{12}$, $L_{13}$, $L_{14}$, $L_{15}$, $L_{16}$, $L_{17}$, $L_{18}$ and $L_{19}$ each represents a methine group; m and n each represents 0, 1 or 2; l and p each represents 0 or 1; and X represents a counter ion;

(V)

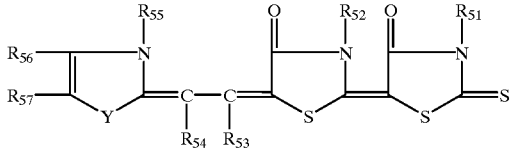

wherein Y represents —S— or —Se—; at least two of $R_{51}$, $R_{52}$, $R_{53}$, $R_{54}$ and $R_{55}$ represent an organic group having a water-soluble group, and $R_{51}$ to $R_{55}$ other than the organic group having a water-soluble group each represents a hydrogen atom, an alkyl group, a substituted alkyl group, an alkenyl group, a substituted alkenyl group, an aryl group or a substituted aryl group; and $R_{56}$ and $R_{57}$, which may be the same or different, each represents a substituted or unsubstituted alkyl, alkenyl, alkynyl, alkoxyl, alkylthio, arylthio, aryl, acyl, alkoxycarbonyl, alkylsulfonyl, carbamoyl or sulfamoyl group, a hydrogen atom, a hydroxyl group, a halogen atom, a carboxyl group or a cyano group, $R_{56}$ and $R_{57}$ may be linked to each other to form a carbocyclic ring, and the carbocyclic ring may have the same or different one or more substituents selected from the substituents defined above for $R_{56}$ and $R_{57}$.

2. The processing method of claim 1, wherein at least one of the silver halide emulsion layer and other hydrophilic colloid layers contains at least one hydrazine compound.

3. The processing method of claim 2, wherein at least one of the silver halide emulsion layer and other hydrophilic colloid layers contains at least one nucleation accelerating agent selected from amine derivatives, onium salts, disulfide derivatives or hydroxymethyl derivatives.

4. The processing method of claim 1, wherein the silver halide in said silver halide emulsion is a silver chlorobromide or silver iodochlorobromide having a silver chloride content of 50 mol % or more.

5. The processing method of claim 2, wherein the silver halide in said silver halide emulsion is a silver chlorobromide or silver iodochlorobromide having a silver chloride content of 50 mol % or more.

6. The processing method of claim 3, wherein the silver halide in said silver halide emulsion is a silver chlorobromide or silver iodochlorobromide having a silver chloride content of 50 mol % or more.

7. The processing method of claim 1, wherein said silver halide emulsion layer is chemically sensitized with a selenium compound or a tellurium compound.

8. The processing method of claim 2, wherein said silver halide emulsion layer is chemically sensitized with a selenium compound or a tellurium compound.

9. The processing method of claim 3, wherein said silver halide emulsion layer is chemically sensitized with a selenium compound or a tellurium compound.

10. The processing method of claim 1, wherein the silver halide emulsion in said photographic material is spectrally sensitized with at least one dye represented by formula (II).

11. The processing method of claim 1, wherein the silver halide emulsion in said photographic material is spectrally sensitized with at least one dye represented by formula (IV).

12. The processing method of claim 1, wherein the silver halide emulsion in said photographic material is spectrally sensitized with at least one dye represented by formula (V).

13. The processing method of claim 1, wherein the at least one dye is present in an amount of from $4\times10^{-6}$ to $8\times10^{-3}$ mol/mol-Ag.

* * * * *